US007022468B2

(12) United States Patent
Nakayama

(10) Patent No.: US 7,022,468 B2
(45) Date of Patent: Apr. 4, 2006

(54) SILVER HALIDE COLOR REVERSAL PHOTOGRAPHIC MATERIAL

(75) Inventor: Tomoyuki Nakayama, Hino (JP)

(73) Assignee: Konica Corporation, Tokyo (JP)

( * ) Notice: Subject to any disclaimer, the term of this patent is extended or adjusted under 35 U.S.C. 154(b) by 120 days.

(21) Appl. No.: 10/651,503

(22) Filed: Aug. 29, 2003

(65) Prior Publication Data

US 2005/0032006 A1 Feb. 10, 2005

(30) Foreign Application Priority Data

Sep. 9, 2002 (JP) ..... 2002-262598

(51) Int. Cl.
*G03C 1/46* (2006.01)
*G03C 1/005* (2006.01)
*G03C 1/494* (2006.01)

(52) U.S. Cl. ..... 430/505; 567/558; 567/570; 567/502; 567/503; 567/600; 567/603; 567/613

(58) Field of Classification Search ..... 430/505, 430/567, 558, 570, 502, 503, 600, 603, 613
See application file for complete search history.

(56) References Cited

U.S. PATENT DOCUMENTS 5,750,320 A * 5/1998 Bogdanowicz et al. ..... 430/505
5,804,356 A * 9/1998 Cole et al. ..... 430/359

* cited by examiner

*Primary Examiner*—Geraldine Letscher
(74) *Attorney, Agent, or Firm*—Lucas & Mercanti LLP

(57) ABSTRACT

A silver halide color reversal photographic material providing images with superior graininess and enhanced sharpness is disclosed, comprising on a support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler, wherein the photographic material has an ISO speed of 80 or more, and exhibits a gradation (γh) of at least 1.1 within the magenta dye density range of 0.3 to 1.0 on the characteristic curve and a gradation (γs) of at least 1.9 within the magenta dye density range of 1.0 to 2.5 on the characteristic curve and the photographic material satisfies the following requirement of interimage effect characteristic values (IIEh, IIEs):

$$|IIEh/IIEs|>1.00$$

10 Claims, No Drawings

SILVER HALIDE COLOR REVERSAL PHOTOGRAPHIC MATERIAL

FIELD OF THE INVENTION

The present invention relates to a silver halide color reversal photographic light-sensitive material (hereinafter, also denoted as a color reversal photographic material), and in particular, to a color reversal photographic material exhibiting enhanced sensitivity and providing images exhibiting superior graininess and enhanced clearness.

FIELD OF THE INVENTION

From an impression that it was technically difficult to use color reversal photographic materials, thus far the main users thereof have been professional or so-called advanced amateur photographers. However, along with the recent increase of leisure hours and enhanced interest in useful utilization thereof, there has been an increase in amateur users enjoying photography as a hobby, resulting in increased interest in color reversal photographic materials providing high quality images and leading to a marked increase of the typical amateurs enjoying photography as a hobby using reversal photographic materials.

Photographic subject matter of the amateur users covers a wide range, including so-called scenic photography, nature scenes which are called as nature-photos, flowering plants and artistic representation of town scenes. To meet this need, performance of reversal photographic materials has been markedly enhanced, leading to entrance of reversal photographic material exhibiting enhanced image quality and superior color reproduction. However, it do not still offer sufficient reversal photographic materials suitable for nature photos and artistic snap shots which are considered to be the main photographic subject matter.

Thus, expectations entertained by many amateur photographers concern reproduction of an exciting, surprising and impression kept in mind and in many cases, the degree of satisfaction is considered to be enhanced by emphasizing certain image representation. Photographic speed also greatly affects such a degree of satisfaction. Thus, the higher-speed reversal photographic material promotes photographing opportunities of the photographer, thereby leading to increased opportunities for picture-taking of an intended scene, without losing a shutter release opportunity.

There exists a reversal photographic material exhibiting such image representation but it still leaves room for overcoming problems such that commonly used speed is insufficient, granular impression remains in positive images or printed images, resulting in insufficient image quality.

In contrast characteristics of a reversal photographic material, for example, a higher contrast image gives a well-modulated impression and such a characteristic is generally preferable in contrast designation for use in scenic photography. On the other hand, such a high contrast, specifically, increasing contrast in the highlight (or low density) region often results in lowered detail representation and reduced color density. To overcome such a defect, it is an effective technique to enhance interimage effects between the respective color-sensitive layers constituting the reversal photographic material. However, applying such a technique thereto results in lowering of photographic speed, rendering it difficult to achieve a high-speed reversal photographic material. In fact, of low-speed reversal photographic materials for professional use or high level amateur use, one having such a performance is known but there has not been any reversal photographic material having an ISO speed of 80 or more, suitable for use by the typical amateur user.

There was disclosed a silver halide color reversal photographic material containing a specified magenta dye forming coupler, as described in JP-A No. 2002-162715 (hereinafter, the term, JP-A refers to Japanese Patent Application Publication). However, nothing is described therein as to whether or not such a reversal photographic material brings about superior image quality in conjunction with contrast and interimage effects, as described later in this application. Further, JP-A No. 2000-305219 discloses a silver halide color reversal photographic material containing a compound represented by formula (R-1), to be described later. However, it is silent with respect to providing an effect on color reproduction and superior image quality as well as contrast and interimage effect characteristics.

SUMMARY OF THE INVENTION

Accordingly, it is an object of the present invention to provide a silver halide color reversal photographic material having an ISO speed of 80 or more and bringing about images exhibiting superior graininess and enhanced sharpness.

The foregoing object of the invention can be accomplished by the following constitution.

(1) A silver halide color reversal photographic material comprising on a support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler, and having an ISO speed of 80 or more, wherein when exposed and processed in accordance with the following processing to obtain a characteristic curve, the photographic material exhibits a gradation ($\gamma h$) of at least 1.1 within the magenta dye density range of 0.3 to 1.0 on the characteristic curve and a gradation ($\gamma s$) of at least 1.9 within the magenta dye density range of 1.0 to 2.5 on the characteristic curve and the photographic material further meets the following requirement:

$$|IIEh/IIEs|>1$$

Processing:

| Step | Temperature | Time |
|---|---|---|
| First developing | 6 min. | 38° C. |
| Washing | 2 min. | 38° C. |
| Reversal | 2 min. | 38° C. |
| Color developing | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Drying | | |

Compositions of processing solutions used in the above steps

| | |
|---|---|
| **First Developer Solution** | |
| Sodium tetrapolyphosphate | 2 g |
| Sodium sulfite | 20 g |
| Hydroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make 1000 ml (and pH of 9.60). | |
| **Reversal Solution** | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| **Color Developer Solution** | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |
| 2,2-Ethylendithioethanol | 1 g |
| Water to make 1000 ml (pH of 11.70) | |
| **Conditioning solution** | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| **Bleaching Solution** | |
| Sodium ethylenediaminetertaacetate (dihydrate) | 2 g |
| Ammonium ferric ethylenediaminetetraacetate (dihydrate) | 120 g |
| Potassium bromide | 100 g |
| Water to make 1000 ml (pH of 5.56) | |
| **Fixer Solution** | |
| Ammonium thiosulfate | 80 g |
| Sodium sulfite | 5 g |
| Sodium bisulfite | 5 g |
| Water to make 1000 ml (pH o 6.60) | |

and wherein said IIEs and IIEh are defined according to the following equations:

$$IIEs=IIEs(BG)+IIEs(BR)+IIEs(GB)+IIEs(GR)+IIEs(RB)+IIEs(RG)$$

$$IIEh=IIEh(BG)+IIEh(BR)+IIEh(GB)+IIEh(GR)+IIEh(RB)+IIEh(RG)$$

wherein IIEs(BG), IIEs(BR), IIEs(GB), IIEs(GR), IIEs(RB) and IIEs(RG); IIEh(BG), IIEh(BR), IIEh(GB), IIEh(GR), IIEh(RB) and IIEh(RG) are defined as follows;

when the photographic material is exposed to each of blue, green, red, yellow, magenta and cyan light for 1/100 sec. using a white light source of 5400 K and Eastman Kodak gelatin filters CC90B, CC90G, CC90R, CC90Y, CC90M and CC90C and processed according to the processing described above to determine characteristic curves for the respective colors (which is based on the status A densitometry condition), and an exposure amount (Eh) giving a density of 0.4 and an exposure amount (Es) giving a density of 2.0 are determined on the characteristic curves for the respective color-sensitive layers and interimage effect characteristic values (IIE) between the respective color-sensitive layers are determined at densities of 0.4 and 2.0 according to the following equations;

IIE from blue-sensitive layer to green-sensitive layer:

$$IIEs(BG)=-\mathrm{Log}(Es(Y(G))-(-\mathrm{Log}(Es(B'(G)))$$

$$IIEh(BG)=-\mathrm{Log}(Eh(Y(G))-(-\mathrm{Log}(Eh(B'(G)))$$

IIE from blue-sensitive layer to red-sensitive layer:

$$IIEs(BR)=-\mathrm{Log}(Es(Y(R))-(-\mathrm{Log}(Es(B'(R)))$$

$$IIEh(BR)=-\mathrm{Log}(Eh(Y(R))-(-\mathrm{Log}(Eh(B'(G)))$$

IIE from green-sensitive layer to blue-sensitive layer:

$$IIEs(GB)=-\mathrm{Log}(Es(M(B))-(-\mathrm{Log}(Es(G'(B)))$$

$$IIEh(GB)=-\mathrm{Log}(Eh(M(B))-(-\mathrm{Log}(Eh(G'(B)))$$

IIE from green-sensitive layer to red-sensitive layer:

$$IIEs(GR)=-\mathrm{Log}(Es(M(R))-(-\mathrm{Log}(Es(G'(R)))$$

$$IIEh(GR)=-\mathrm{Log}(Eh(M(R))-(-\mathrm{Log}(Eh(G'(R)))$$

IIE from red-sensitive layer to blue-sensitive layer:

$$IIEs(RB)=-\mathrm{Log}(Es(C(B))-(-\mathrm{Log}(Es(R'(B)))$$

$$IIEh(RB)=-\mathrm{Log}(Eh(C(B))-(-\mathrm{Log}(Eh(R'(B)))$$

IIE from red-sensitive layer to green-sensitive layer:

$$IIEs(RG)=-\mathrm{Log}(Es(C(G))-(-\mathrm{Log}(Es(R'(G)))$$

$$IIEs(RG)=-\mathrm{Log}(Eh(C(G))-(-\mathrm{Log}(Eh(R'(G)))$$

wherein in the foregoing designations generally represented by Es(A(B)) and Eh(A(B)), "A" represents a filter used in exposure and "B" represents a color-sensitive layer exposed, and Y: exposure using the CC90Y filter,
B: exposure using the CC90B filter,
M: exposure using the CC90M filter,
G: exposure using the CC90G filter,
C: exposure using the CC90C filter,
R: exposure using the CC90R filter,
B: blue-sensitive layer,
G: green-sensitive layer,
R: red-sensitive layer.

DETAILED DESCRIPTION OF THE INVENTION

One aspect of this invention concerns a silver halide color reversal photographic material having an ISO speed of not less than 80, preferably an ISO speed of not less than 100, and more preferably an ISO speed of not less than 160.

The ISO speed of the color reversal photographic material can be determined in accordance with the method described in ISO 2240-1993 (Photography-Color reversal camera films-Determination of ISO speed).

The gradation (or gamma) within the dye density range between 0.3 and 1.0 (designated γh) is the slope of a straight line connecting two points corresponding to densities of 0.3 and 1.0 on the characteristic curve, which is defined as below:

$$\gamma h = 0.7/(\text{Log } El - \text{Log } Eh)$$

where El represents the exposure amount giving a magenta, cyan or yellow dye density of 0.3 on the corresponding characteristic curve, based on a status A density and Eh represents the exposure amount giving a density of 1.0 for the same dye. Similarly, the gradation within the dye density range between 1.0 and 2.5 (designated γs) is the slope of a straight line connecting two points corresponding to densities of 1.0 and 2.5 on the characteristic curve, which is defined as below:

$$\gamma s = 1.5/(\text{Log } El' - \text{Log } Eh')$$

where El' is the exposure amount giving a magenta, cyan or yellow dye density of 1.0 on the corresponding characteristic curve, based on a status A density and Eh' represents an exposure amount giving a density of 2.5 for the same dye.

Processing is conducted according to the same processing steps using the processing solutions as described above. Processing, which is substantially equivalent to the foregoing processing is also applicable in this invention. Examples of such processing include process E-6 (Eastman Kodak).

Status A density is commonly known in the photographic art, as defined in International Standard ISO 5-3 and also described in, for example, T. H. James, The Theory of the Photographic Process, Fourth edition (1977, Macmillan Publishing Co., Inc.; Phot. Sci. Eng., 17, 461 (1973); and Handbook of Photographic Science and Engineering, Second edition (1997), page 573. Thus, (ISO) status A density is a measure of the optical densities in the blue, green, and red regions of the spectrum for an image of color reversal photographic films or reflection color prints intended to be viewed directly or through projection In this invention, the γh is at least 1.1, and preferably 1.1 to 1.3; the γs is at least 1.9, and preferably 1.95 to 2.20. Specifically, a γh of not more than 1.3 results in little loss of representation in the low density region and a γs of not more than 2.2 minimizes lacking details and such γh and γs values are specifically preferred to achieve the object of this invention.

The IIEs and IIEh values defined in this invention, which represent interimage effect characteristic values, can be determined in the following manner.

Thus, the silver halide color reversal photographic material according to this invention is exposed, through an optical wedge, to each of blue, green, red, yellow, magenta and cyan light for 1/100 sec. using a white light source of 5400 K and specific filters, and processed according the processing steps and using the processing solutions described earlier. In the process, it is preferred that the stabilizing step (or final rinsing step) be intervened between the final washing step and the drying step. In the stabilizing step, a stabilizer solution having the following composition is used:

| Stabilizer Solution | |
|---|---|
| Formalin (37 wt %) | 5 ml |
| KONIDUCKS (available from Konica Corp.) | 5 ml |
| Water to make 1000 ml (pH of 7.00). | |

To conduct exposure to blue, green, red, yellow, magenta and cyan light, Eastman Kodak gelatin filters, CC90B, CC90G, CC90R, CC90Y, CC90M and CC90 are respectively used. Instead of the foregoing filters, there may also be used filters having the same spectral transmission characteristics as the foregoing filters.

On the thus prepared characteristic curves of the color reversal photographic material (of which the densitometry is based on status A density), an exposure amount giving a density of 0.4 and an exposure amount giving a density of 2.0 are determined for each of the blue-sensitive, green-sensitive and red-sensitive layers when exposed to each of blue, green, red, yellow, magenta and cyan light. Herein, the exposure amount giving a density of 0.4 and the exposure amount giving a density of 2.0 are generally expressed in terms of Eh(A(X)) and Es(A(X)), respectively, in which "A" represents a specified filter used in exposure and "X" represents a specified color-sensitive layer selected from the blue-sensitive, green-sensitive and red-sensitive layers. Thus, the Eh(A(X)) and Es(A(X)) represent an exposure amount giving a density of 0.4 and an exposure amount giving a density of 2.0, respectively, on the characteristic curve of a color-sensitive layer of X when exposed through filter A. From the thus obtained exposure amounts, interimage effect characteristic values (designated IIE) between the respective color-sensitive layers are determined at each of densities of 0.4 and 2.0, according to the following equations.

IIE from blue-sensitive layer (B) to green-sensitive layer (G):

$$IIEs(BG) = -\text{Log}(Es(Y(G)) - (-\text{Log}(Es(B'(G)))$$

$$IIEh(BG) = -\text{Log}(Eh(Y(G)) - (-\text{Log}(Eh(B'(G)))$$

IIE from blue-sensitive layer (B) to red-sensitive layer (R):

$$IIEs(BR) = -\text{Log}(Es(Y(R)) - (-\text{Log}(Es(B'(R)))$$

$$IIEh(BR) = -\text{Log}(Eh(Y(R)) - (-\text{Log}(Eh(B'(G)))$$

IIE from green-sensitive layer (G) to blue-sensitive layer (B):

$$IIEs(GB) = -\text{Log}(Es(M(B)) - (-\text{Log}(Es(G'(B)))$$

$$IIEh(GB) = -\text{Log}(Eh(M(B)) - (-\text{Log}(Eh(G'(B)))$$

IIE from green-sensitive layer to red-sensitive layer (R):

$$IIEs(GR) = -\text{Log}(Es(M(R)) - (-\text{Log}(Es(G'(R)))$$

$$IIEh(GR) = -\text{Log}(Eh(M(R)) - (-\text{Log}(Eh(G'(R)))$$

IIE from red-sensitive layer (R) to blue-sensitive layer (B):

$$IIEs(RB) = -\text{Log}(Es(C(B)) - (-\text{Log}(Es(R'(B)))$$

$$IIEh(RB) = -\text{Log}(Eh(C(B)) - (-\text{Log}(Eh(R'(B)))$$

IIE from red-sensitive layer (R) to green-sensitive layer (G):

$$IIEs(RG) = -\text{Log}(Es(C(G)) - (-\text{Log}(Es(R'(G)))$$

$$IIEs(RG) = -\text{Log}(Eh(C(G)) - (-\text{Log}(Eh(R'(G))).$$

In the foregoing, as generally designated Es(A(B)) and Eh(A(B)), "A" represents a filter used in exposure and "B" represents a color-sensitive layer exposed, that is, designated as follows:

Y: exposure using the CC90Y filter (which may be replaced by a filter having the same spectral transmittance), B': exposure using the CC90B filter (which may be replaced by a filter having the same spectral transmittance), M: exposure using the CC90M filter (which may be replaced by a filter having the same spectral transmittance), G': exposure using the CC90G filter (which may be replaced by a filter having the same spectral transmittance), C: exposure using the CC90C filter (which may be replaced by a filter having the same spectral transmittance), R': exposure using the CC90R filter (which may be replaced by a filter having the same spectral transmittance), B: blue-sensitive layer, G: green-sensitive layer, R: red-sensitive layer.

Specifically in the foregoing equations, IIEs(BG) and IIEh(BG) represent characteristic values of interimage effects from the blue-sensitive layer to the green-sensitive layer at densities of 2.0 and 0.4, respectively; Es(Y(G)) and Eh(Y(G)) represent exposure amounts giving densities of 2.0 and 0.4 of the green-sensitive layer, respectively, when exposed through filter Y (or CC90Y); Es(B'(G)) and Eh(B'(G)) represent exposure amounts giving densities of 2.0 and 0.4 of the green-sensitive layer, respectively, when exposed through filter B' (or CC90B);

IIEs(BR) and IIEh(BR) represent characteristic values of interimage effects from the blue-sensitive layer to the red-sensitive layer at densities of 2.0 and 0.4, respectively; Es(Y(R)) and Eh(Y(R)) represent exposure amounts giving densities of 2.0 and 0.4 of the red-sensitive layer, respectively, when exposed through filter Y (or CC90Y); Es(B'(R)) and Eh(B'(R)) represent exposure amounts giving densities of 2.0 and 0.4 of the red-sensitive layer, respectively, when exposed through filter B' (or CC90B);

IIEs(GB) and IIEh(GB) represent characteristic values of interimage effects from the green-sensitive layer to the blue-sensitive layer at densities of 2.0 and 0.4, respectively; Es(M(B)) and Eh(M(B)) represent exposure amounts giving densities of 2.0 and 0.4 of the blue-sensitive layer, respectively, when exposed through filter M (or CC90M); Es(G'(B)) and Eh(G'(B)) represent exposure amounts giving densities of 2.0 and 0.4 of the blue-sensitive layer, respectively, when exposed through filter G' (or CC90G);

IIEs(GR) and IIEh(GR) represent characteristic values of interimage effects from the green-sensitive layer to the red-sensitive layer at densities of 2.0 and 0.4, respectively; Es(M(R)) and Eh(M(R)) represent exposure amounts giving densities of 2.0 and 0.4 of the red-sensitive layer, respectively, when exposed through filter M (or CC90M); Es(G'(R)) and Eh(G'(R)) represent exposure amounts giving densities of 2.0 and 0.4 of the red-sensitive layer, respectively, when exposed through filter G' (or CC90G);

IIEs(RB) and IIEh(RB) represent characteristic values of interimage effects from the red-sensitive layer to the blue-sensitive layer at densities of 2.0 and 0.4, respectively; Es(C(B)) and Eh(C(B)) represent exposure amounts giving densities of 2.0 and 0.4 of the blue-sensitive layer, respectively, when exposed through filter C (or CC90C); Es(R'(B)) and Eh(R'(B)) represent exposure amounts giving densities of 2.0 and 0.4 of the blue-sensitive layer, respectively, when exposed through filter R' (or CC90R);

IIEs(RB) and IIEh(RB) represent characteristic values of interimage effects from the red-sensitive layer to the green-sensitive layer at densities of 2.0 and 0.4, respectively; Es(C(G)) and Eh(C(G)) represent exposure amounts giving densities of 2.0 and 0.4 of the green-sensitive layer, respectively, when exposed through filter C (or CC90C); Es(R'(G)) and Eh(R'(G)) represent exposure amounts giving densities of 2.0 and 0.4 of the green-sensitive layer, respectively, when exposed through filter R' (or CC90R).

The expression, for example, IIE from blue-sensitive layer (B) to green-sensitive layer (G) means the characteristic value of an interimage effect which is provided to the green-sensitive layer from the blue-sensitive layer. Similarly, the IIE from green-sensitive layer (G) to blue-sensitive layer (B) means the characteristic value of an interimage effect which is provided to the blue-sensitive layer from the green-sensitive layer.

The interimage effect characteristic values defined in this invention, IIEs and IIEh are defined based on the following equations:

$$IIEs=IIEs(BG)+IIEs(BR)+IIEs(GB)+IIEs(GR)+IIEs(RB)+IIEs(RG)$$

$$IIEh=IIEh(BG)+IIEh(BR)+IIEh(GB)+IIEh(GR)+IIEh(RB)+IIEh(RG)$$

The silver halide color reversal photographic material according to this invention meets the requirement of $|IIEh|/|IIEs|>1.00$, preferably $|IIEh|/|IIEs|>1.10$, and more preferably $|IIEh|/|IIEs|>1.15$.

The silver halide color reversal photographic material according to this invention comprises on a support at least one blue-sensitive silver halide emulsion layer containing a yellow dye forming coupler, at least one green-sensitive silver halide emulsion layer containing a magenta dye forming coupler and at least one red-sensitive silver halide emulsion layer containing a cyan dye forming coupler. It is preferred that at least one of the foregoing three silver halide emulsion layers comprises plural silver halide emulsion layers containing a dye forming coupler. Such plural silver halide emulsion layers are those which are different in sensitivity (or speed).

Of the plural, coupler-containing silver halide emulsion layers (which are also denoted as identical color sensitivity units), at least 50% of the total projected area of silver halide grains contained in the highest-speed silver halide emulsion layer is preferably accounted for by tabular silver halide grains having a aspect ratio of at least 5, an average iodide content of a host grains (which is hereinafter also denoted as an average host grain iodide content) of 4 mol % or less, at least 10 dislocation lines in the fringe portions of the grains and a coefficient of variation of grain size (circular equivalent diameter) of 25% or less. In the foregoing, the host grain refers to a silver halide grain immediately before introducing the dislocation lines.

The tabular silver halide grains preferably have an aspect ratio of at least 7, and more preferably at least 10. The tabular grains preferably have a coefficient of variation (standard deviation, divided by average grain size) of grain size (circular equivalent diameter) of not more than 25%, preferably not more than 20%, and more preferably not more than 15%, in which the circular equivalent diameter refers to a diameter of a circle having the same area as the projected area of the major face of the tabular grain. The average tabular grain size is preferably 0.1 to 2.0 μm, more preferably 0.2 to 1.0 μm, and still more preferably not more than 0.2 μm.

The tabular silver halide grains used in the color reversal photographic material relating to this invention have preferably at least 10 (more preferably at least 30) dislocation lines per grain, in the fringe portions of the grains. The dislocation lines in tabular grains can be directly observed using a transmission electron microscope at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213.

The method for introducing the dislocation lines is not specifically limited, however, a method of introducing the dislocation by employing a steep gap of the silver halide lattice constant due to a steep difference in halide composition is preferred, in which a high iodide layer is formed at the time of starting the introduction of the dislocation lines and then a lower iodide layer is formed outside the high iodide layer. Examples of the method for forming the high iodide phase include double jet addition of an aqueous iodide (e.g., potassium iodide) solution and an aqueous silver salt (e.g., silver nitrate) solution, addition of silver iodide fine grains, addition of an iodide solution alone and the use of a compound capable of releasing an iodide ion (iodide ion releasing agent), as described in JP-A No. 6-11781 and 8-62754, and of these, the double jet addition of an aqueous iodide solution and an aqueous silver salt solution, the addition of silver iodide fine grains and the use of iodide ion releasing agents are preferred, and the used of the iodide ion releasing agents is more preferred.

To control the density of dislocation lines or the proportion of dislocation line containing grains, it is preferred to adjust concentrations of mixing solution at the start of introducing dislocation lines. It is preferred to mix solutions with concentration to enhance the density of dislocation lines or the proportion of dislocation line containing grains. Preferred examples of such concentration include a ultrafiltration described in, e.g., JP-A No. 2001-56518, in which water or soluble salts are removed from the reaction mixture during the grain formation stage.

Host grains used in this invention preferably have an average iodide content of not more than 4 mol %, more preferably not more than 2 mol %, and still more preferably not more than 0.5 mol %, in which the iodide is included preferably homogeneously. The average iodide content of tabular grains is preferably 0.5 to 4.0 mol %, and more preferably 1 to 3.0 mol %. The tabular silver halide grains used in this invention are mainly comprised of silver iodobromide, which may further contain other halides, such as chloride. A coefficient of variation of iodide content distribution among the tabular grains is preferably not more than 30%, and more preferably not more than 20%.

In the color reversal photographic material according to this invention, at least one color-sensitive silver halide emulsion layer comprises plural silver halide emulsion layers which are the same in color-sensitivity and different in photographic speed, in which the lowest speed silver halide emulsion layer contains silver halide grains accounting for at least 30% of the projected area of total grains contained in the layer and having a proportion of a (100) face per grain of at least 70%. Hereinafter, the proportion of a (100) face per grain is called simply as a (100) face proportion, and grains having such a (100) face proportion are also called (100) face grains. The (100) face proportion of the grains can be determined by conventional X-ray diffractometry or the method utilizing dye adsorption.

The coefficient of variation of the (100) face proportion among grains is preferably not more than 15%, and more preferably not more than 10%. The coefficient of variation of the (100) face proportion among grains (K %) is defined by the following formula:

$$K = \left( \sqrt{\frac{\sum_{n=1}^{N} (A-\alpha)^2}{N}} \Big/ \alpha \right) \times 100$$

where A (%) is a proportion of (100) face of a grain, N is the number of grains to be measured and α(%) is an average value of (100) face proportion.

The coefficient of variation can be determined in the following manner. The proportion of (100) faces of each grain can be determined in such a manner that metal is deposited from the oblique direction (i.e., shadowing treatment) and observed with SEM (Scanning Electron Microscope), after which the observed images are subjected to image processing. The proportion of (100) face of emulsion grains can be determined employing X-ray diffractometry or dye adsorption, whereby the average value of a number of silver halide grains but the proportion of (100) face of individual grain cannot be determined.

When subjecting grains to the shadowing treatment and observing the grains from the upper side by employing the shadow caused by the amount of metal deposited, a (100) face and a non-(100) face could be successfully distinguished. The shadowing treatment is a technique for providing a shadow as grains which has commonly been used in replica observation of silver halide grains and described in "Collective Electron Microscope Sample Technique" published by Seibundo Shinkosha, page 123 (1970).

The proportion of a (100) face of the grain can be determined according to the following procedure. To take silver halide grains out of a silver halide emulsion, gelatin used as a dispersing medium is degraded with a proteinase under a safelight, and subjected to repeated removal of supernatant by centrifugation and washing with distilled water. In cases where silver halide grains are present in a coating layer containing gelatin as a binder, the grains can be taken out in a similar manner using a proteinase. In cases where a polymeric material other than gelatin is contained therein, it can be removed by dissolving the polymeric material with an appropriate organic solvent. In cases where a sensitizing dye or dyestuff is adsorbed onto the grain surface, these materials can be removed using an alkaline aqueous solution or alcohols to produce a clean silver halide grain surface. Silver halide grains dispersed in water are coated on a conductive substrate and dried. It is preferred to arrange the grains on the substrate without causing aggregation of the grains. The thus prepared grain sample is observed using an optical microscope or a scanning electron microscope. A dispersing aid may be employed to prevent grain aggregation. After degradation with a proteinase, a silver halide grain dispersion which has been diluted with distilled water may be coated on the conductive substrate. A rotation drier or a vacuum freeze drier may optimally be employed to allow the grains to be arranged on the substrate without causing the aggregation. A conductive substrate surface which is smooth and contains no element exhibiting a high secondary ion yield, such as an alkali metal, is preferred and a mirror plane-polished, low-resistive silicon wafer exhibiting resistivity of not more than 1.0 Ω·cm which has been sufficiently washed is preferably employed. A smooth polyethylene terephthalate base on which carbon is thinly deposited to provide conductivity may also be used.

Onto the silver halide grains dispersed on a substrate, metal is allowed to deposit from the direction of an angle of 45°. Metals to be deposited are generally Cr and Pt—Pd and preferably are platinum carbon in terms of graininess of the deposited membrane as well as linearity of evaporation. When the metal-deposited membrane is too thin, the contrast difference necessary to distinguish the (100) face from non-(100) faces cannot be obtained. On the other hand, a thick membrane increases errors in measurement, therefore, the thickness is preferably 20 nm or so. The SEM is preferably a higher resolution apparatus to enhance measurement precision. Observation is made at an electron beam accelerating voltage of 1.8 kV, whereby a sufficient contrast difference is obtained to make easy distinction of turned-up (100) faces, external form of grains or substrate in the subsequent image processing stage. Observation is made from the upper side, without inclining the sample. Observed images are photographed using a Polaroid film or a conventional negative film and may then be read with a scanner into a computer for image processing. To prevent deterioration of such read images, it is preferred to save them as digitized images on line, connecting the SEM to a computer for image processing. The read images are then subjected to a median filter to remove impulse errors of images. Thereafter, binary-coding is made at a threshold value enabling image extraction of turned-up (100) faces and the grain contour, after which an area of each grain is measured numbering the grains. Inputting measured (100) face areas and an area within the grain contour into a text calculation software in the form of ASCII, the (100) face proportion of each grain can be determined.

It is preferred to reduce the (100) face proportion according to the following method. The pAg of forming cubic grains is preferably 6.8 to 7.8 in terms of stability of the face proportion. In addition, a method of supplying an iodide to a reaction mixture to grow grains is essential; the use of fine silver iodide grains or the use of an iodide releasing agent is effective for reducing the variation coefficient of the (100) face proportion among grains. This effect is supposed to result from the iodide ion distribution being made homogeneous in a mixing vessel. It is particularly important in the preparation of silver halide grains containing dislocation lines. To enhance homogeneity of the contents in the mixing vessel, it is preferred to use a means such as increasing a linear speed of stirring a solution in the mixing vessel or reducing the silver halide concentration in the mixing vessel. The stirring speed (or rotation speed) is preferably increased to the point of causing no foam. The silver halide concentration is preferably 0 to 2 mole per liter immediately before starting grain growth, 0 to 1.5 mole per liter immediately after completing grain growth and 0 to 5 mole per liter during grain growth.

It is preferred to supply iodide ions using fine silver iodide grains or an iodide ion releasing agent described in JP-A No. 6-11781 and 8-62754 to reduce a coefficient of variation of the (100) face proportion distribution among grains. The average iodide content of (100) face grains is preferably 1 to 5 mol %, and more preferably 2 to 4 mol %.

Silver halide grains usable in this invention may be comprised of a homogeneous halide composition or different halide compositions, such as core shell structure grains. The structure regarding halide composition can be determined by composition analysis using the X-ray diffractometry or EPMA.

The (100) face grains preferably have an average grain size of 0.1 to 0.5 μm, in which the grain size is defined as an edge length of a cube having a volume equivalent to that of the grain. The (100) face grains also preferably have a coefficient of variation of grain size (i.e., standard deviation, divided by average grain size) of not more than 20%, and preferably not more than 10%. A coefficient of variation of iodide content distribution among (100) face grains is preferably not more than 30%, and more preferably not more than 20%.

In this invention, even when an emulsion obtained by blending at least two (100) face grain emulsions differing in grain size or halide composition is incorporated into the lowest speed layer, effects of this invention can be achieved.

The (100) face grains used in this invention preferably contain dislocation lines.

In the case of cubic grains, it is often difficult to observe electron beam transmission images due to their grain thickness. In such a case, a silver halide grain is sliced to not more than 0.25 μm thick, in the direction parallel to the (100) face, while carefully applying pressure so as not to cause dislocation so that the dislocation lines can be confirmed by observing the thus obtained slice. The presences of the dislocation lines can be estimated by the analysis method employing a half-width of powder X-ray diffraction lines. Introduction of the dislocation lines into silver halide grains used in the invention is started preferably at the time when 20 to 90% of the silver amount used for growing the silver halide grains (and more preferably within 25 to 75%) is consumed. The method for introducing the dislocation lines is not specifically limited, however, a method of introducing the dislocation by employing a steep gap of the silver halide lattice constant due to a steep difference in halide composition is preferred, in which a high iodide layer is formed at the time of starting the introduction of the dislocation lines and then a lower iodide layer is formed outside the high iodide layer. Preferred examples of the method for forming the high iodide include addition of an aqueous iodide (e.g., potassium iodide) solution, along with an aqueous silver salt (e.g., silver nitrate) solution by a double jet technique; addition of silver iodide fine grains; addition of an iodide solution alone and addition of a compound capable of releasing an iodide ion, and of these, the addition of silver iodide fine grains is more preferred.

The preparation of silver halide grains relating to the invention can be made according to methods known in the art alone or in combination, as described in JP-A 61-6643, 61-146305, 62-157024, 62-18556, 63-92942, 63-151618, 63-163451, 63-220238, and 63-311244. Example thereof include simultaneous addition, a double jet method, a controlled double jet method in which the pAg of a liquid phase forming silver halide grains is maintained at a given value, and a triple jet method, in which soluble silver halides different in halide composition are independently added. Normal precipitation and reverse precipitation in which grains are formed in an environment of excessive silver ions are also applied. The pAg of the liquid phase forming silver halide grains can be controlled so as to meet the grain growth rate and this technique is preferred to prepare highly monodisperse-grains. The addition rate is referred to techniques described in JP-A 54-48521 and 58-49938.

Silver halide solvents are optionally employed. Examples thereof include ammonia, thioethers and thioureas. The thioethers are referred to U.S. Pat. Nos. 3,271,157, 3,790, 387, and 3,574,628. The mixing method is not specifically limited, and neutral precipitation, ammoniacal precipitation and acidic precipitation are applied. The pH is preferably not more than 5.5, and more preferably not more than 4.5 in terms of reduced fogging of silver halide grains.

The lowest-speed layer containing (100) face grains, described above preferably contains a compound represented by the following formula (R-1):

formula (R-1)

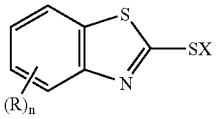

wherein X represents a hydrogen atom or an alkali metal; R represents a hydrogen atom, a halogen atom or an alkyl group having 1 to 5 carbon atoms; and n is an integer of 1 to 4. This compound is preferably contained at least 15 $mg/m^2$, and more preferably 25 to 80 $mg/m^2$. Specific examples of the compound of formula (R-1) are shown below but are not limited to these.

(R-1)-1

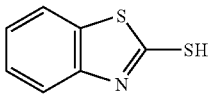

(R-1)-2

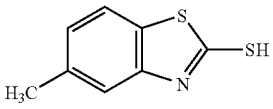

(R-1)-3

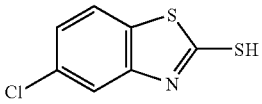

(R-1)-4

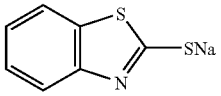

(R-1)-5

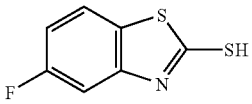

(R-1)-6

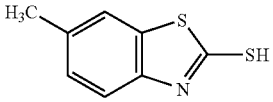

(R-1)-7

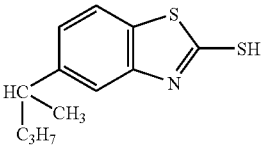

(R-1)-8

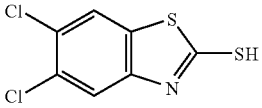

Silver halide grains are generally formed in the presence of a dispersing medium. The dispersion medium is a substance capable of forming a protective colloid, and gelatin is preferably employed. Examples of gelatin used as dispersing medium include an alkali processed gelatin and acid processed gelatin. Preparation of gelatin is detailed in A. Veis, The Macromolecular Chemistry of Gelatin, published Academic press, 1964. Examples of hydrophilic colloidal materials other than gelatin include gelatin derivatives, a graft polymer of gelatin and other polymer, proteins such as albumin and casein, cellulose derivatives such as hydroxyethyl cellulose, carboxymethyl cellulose and cellulose sulfuric acid esters, saccharide derivatives such as sodium alginate and starch derivatives and synthetic polymeric materials, such as polyvinyl alcohol, polyvinyl alcohol partial acetal, poly-N-vinyl pyrrolidone, polyacrylic acid, polymethacrylic acid, polyacrylamide, polyvinyl imidazole and polyvinyl pyrazole, including their copolymers. Gelatin is preferably one which exhibits not less tan 200 of a jerry strength, defined in the PAGI method.

At the stage of forming silver halide grains, washing, chemical ripening or coating, is preferably incorporated a metal ion selected from the metals of Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. The metal is incorporated in the form of an ammonium, acetate, nitrate, sulfate, phosphate, hydroxide, or a metal complex salt such as six-coordinated complex and four-coordinated complex. Exemplary examples thereof include $Pb(NO_3)_2$, $K_2Fe(CN)_6$, $K_3IrCl_6$, $K_3RhCl_6$ and $K_4Ru(CN)_6$. A chalcogen compound may be added during the preparation of emulsions, as described in U.S. Pat. No. 3,772,031.

The silver halide grain emulsions may be subjected to desalting to remove soluble salts. Desalting can be applied at any time during the growth of silver halide grains, as described in JP-A 60-138538. Desalting can be carried out according to the methods described in Research Disclosure Vol. 176, item 17643, section II at page 23. Exemplarily, a noodle washing method in which gelatin is gelled, and a coagulation process employing an inorganic salts, anionic surfactants (e.g., polystyrene sulfonic acid) or a gelatin derivative (e.g., acylated gelatin, carbamoyl gelatin) are used. Alternatively, ultrafiltration can also be applied, as described in JP-A 8-228468.

Silver halide emulsions used in the invention can be subjected to reduction sensitization. The reduction sensitization can be performed by adding a reducing agent to a silver halide emulsion or a mixture solution used for grain growth, or by subjecting the silver halide emulsion or a mixture solution used for grain growth to ripening or grain growth, respectively, at a pAg of not more than 7 or at a pH of not less than 7. The reduction sensitization can also be performed before or after the process of chemical sensitization, as described in JP-A 7-219093 and 7-225438. The reduction sensitization may be conducted in the presence of an oxidizing agent, and preferably, a thiosulfonic acid compound represented by formulas (i) to (iii) described later. Preferred reducing agents include thiourea dioxide, ascorbic acid and its derivatives and stannous salts. Examples of other reducing agents include borane compounds, hydrazine derivatives, formamidinesulfinic acid, silane compounds, amines and polyamines, and sulfites. The reducing agent is added preferably in an amount of $10^{-8}$ to $10^{-2}$ mol per mol of silver halide.

To ripen at low pAg, a silver salt may be added and aqueous soluble silver salts are preferably employed, such as silver nitrate. The pAg during ripening is not more than 7, preferably not more than 6, and more preferably between 1 and 3. To ripen at high pH, an alkaline compound may be added to a silver halide emulsion or a reaction mixture solution for grain growth. Examples of the alkaline compound include sodium hydroxide, potassium hydroxide, sodium carbonate, potassium carbonate and ammonia. In the case when adding ammoniacal silver nitrate to form silver halide, alkaline compounds other than ammonia are preferably employed.

The silver salt or alkaline compound may be added instantaneously or in a given time, and at a constant flow rate or a variable flow rate. The addition may be dividedly made. Prior to the addition of aqueous soluble silver salt and/or halide, the silver salt or alkaline compound may be allowed to be present in a reaction vessel. Further, the silver salt or alkaline compound may be incorporated to an aqueous silver salt solution and added together with the aqueous soluble silver salt. Furthermore, the silver salt or alkaline compound mat be added separately from the aqueous soluble silver salt or halide.

An oxidizing agent may be added to the silver halide emulsion during the formation thereof. The oxidizing agent is a compound capable of acting on metallic silver to convert to a silver ion. The silver ion may be formed in the form of a scarcely water-soluble silver salt, such as silver halide, silver sulfide or silver selenide, or in the form of an aqueous soluble silver salt, such as silver nitrate. The oxidizing agent may be inorganic compound or an organic compound. Examples of inorganic oxidizing agents include ozone, hydrogen peroxide and its adduct (e.g., $NaBO_2.H_2O_2.3H_2O$, $2Na_2CO_3.3H_2O_2$, $Na_4P_2O_7.2H_2O_2$, $2Na_2SO_4.H_2O_2.H_2O$), peroxy-acid salt (e.g., $K_2S_2O_8$, $K_2C_2O_6$, $K_4P_2O_8$), peroxy-complex compound {$K_2[Ti(O_2)OOCCOO].3H_2O$, $4K_2SO_4$ $Ti(O_2)OH.SO_4.2H_2O$, $Na_3[VO(O_2)(OOCCOO)_2.6H_2O]$}, oxygen acid such as permaganates (e.g., $KMnO_4$), chromates (e.g., $K_2Cr_2O_7$),halogen elements such as iodine or bromine, perhalogenates (e.g., potassium periodate), high valent metal salts (e.g., potassium ferricyanate) and thiosulfonates. Examples of organic oxidizing agents include quinines such as p-quinone, organic peroxides such as peracetic acid and perbenzoic acid, and active halogen-releasing compounds (e.g., N-bromsuccimide, chloramines T, chroramine B). Of these oxidizing agents, ozone, hydrogen peroxide and its adduct, halogen elements, thiosulfonate, and quinines are preferred. Specifically, thiosulfonic acid compounds represented by the following formulas (i) to (iii) are preferred, and the compound represented by formula (1) is more preferred:

$$R^1—SO_2S\text{-}M \quad \text{(i)}$$

$$R^1—SO_2S—R^2 \quad \text{(ii)}$$

$$R^1SO_2S\text{-}L_nSSO_2—R^3 \quad \text{(iii)}$$

where $R^1$, $R^2$ and $R^3$, which may be the same or different, each represents an aliphatic group, aromatic group or a heterocyclic group; M is a cation, L id a bivalent linkage group; and n is 0 or 1. The oxidizing agent is incorporated preferably in an amount of $10^{-7}$ to $10^{-1}$ mole, more preferably $10^{-1}$ to $10^{-2}$ mole, and still more preferably $10^{-5}$ to $10^{-3}$ mole per mole of silver. The oxidizing agent may be added during grain formation, or before or during forming structure having different halide compositions. The oxidizing agent can be incorporated according to the conventional manner. For examples, an aqueous soluble compound may be incorporated in the form of an aqueous solution; an aqueous insoluble or sparingly soluble compound may be incorporated through solution in an appropriate organic solvent (e.g., alcohols, glycols, ketones, esters and amides).

Silver halide grains used in this invention may be subjected to chemical sensitization. Chalcogen sensitization with a compound containing a chalcogen such as sulfur, selenium or tellurium, or noble metal sensitization with a compound of a noble metal such as gold are performed singly or in combination.

Tabular silver halide grain emulsions used in invention are preferably subjected to selenium sensitization. Preferred selenium sensitizers are described in JP-A 9-265145. The amount of a selenium compound to be added, depending on the kind of the compound, the kind of a silver halide emulsion and chemical ripening conditions, is preferably $10^{-8}$ to $10^{-3}$ moles, and more preferably $5\times10^{-8}$ to $10^{-4}$ mole per mol of silver. The selenium compound may be added through solution in water or an organic solvent such as methanol, ethanol or ethyl acetate. It may be added in the form of a mixture with an aqueous gelatin solution. Further, it may be added in the form of a emulsified dispersion of an organic solvent-soluble polymer, as described in JP-A 4-140739. The pAg at the time of selenium sensitization is preferably 6.0 to 10.0, and more preferably 6.5 to 9.5. The pH is preferably 4.0 to 9.0, and more preferably 4.0 to 6.5; and the temperature is preferably 40 to 90° C. and more preferably 45 to 85° C. The selenium sensitization may be performed in combination with sulfur sensitization, gold sensitization, or both of them.

There can be employed sulfur sensitizers described in U.S. Pat. Nos. 1,574,944, 2,410,689, 2,278,947, 2,728,668, 3,501,313, and 3,656,955; West German Patent (OLS) 1,422,869; JP-A 55-45016, 56-24937, and 5-165135. Preferred exemplary examples thereof include thiourea derivatives such as 1,3-diphenyl thiourea, triethylthiourea and 1-ethyl-3(2-thiazolyl)thiourea; rhodanine derivatives; dithiacarbamates, polysulfide organic compounds; and sulfur single substance. The amount of the sulfur sensitizer to be added, depending on the kind of the compound, the kind of a silver halide emulsion and chemical ripening conditions, is preferably $1\times10^{-9}$ to $10^{-4}$ moles, and more preferably $1\times10^{-8}$ to $1\times10^{-5}$ mole per mol of silver.

Examples of gold sensitizers include chloroauric acid, gold thiosulfate, gold thiocyanate, and gold complexes of thioureas, rhodanines and other compounds. The amount of a gold sensitizer to be added, depending on the kind of silver halide emulsion, the kind of a compound to be used and ripening conditions, is preferably $1\times10^{-9}$ to $1\times10^{-4}$ mol and more preferably $1\times10^{-8}$ to $1\times10^{-5}$ mol per mol of silver halide.

Further, chemical sensitizers to be used in combination include noble metal salts such as platinum, palladium and rhodium, as described in U.S. Pat. Nos. 2,448,060, 2,566,245 and 2,566,263. The chemical sensitization may be carried out in the presence of thiocyanates (e.g., ammonium thiocyanate, potassium thiocyanate) or tetra-substituted thioureas (e.g., tetramethyl thiourea), which are a silver halide solvent.

The silver halide grains used in the invention may be a surface latent image type or internal latent image type, including internal latent image forming grains described in JP-A 9-222684.

In the color reversal photographic material according to this invention, the silver halide emulsion layer containing a magenta dye forming coupler preferably contains a magenta dye forming coupler represented by the following formula (M-1) or (M-1'):

formula (M-1)

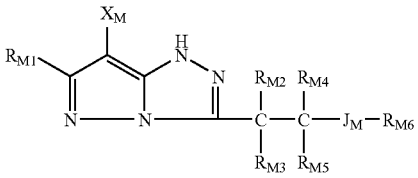

formula (M-1′)

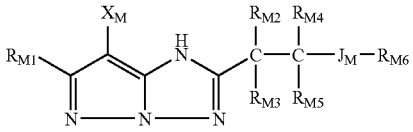

wherein $R_{M1}$ represents a hydrogen atom or a substituent; $R_{M2}$ and $R_{M3}$ each represents an alkyl group; $R_{M4}$ and $R_{M5}$ each represents a hydrogen atom or an alkyl group; $J_M$ represents —O—C(═O)—, —$NR_{M7}$CO— or —$NRM_7SO_2$—, in which $R_{M7}$ represents a hydrogen atom or an alkyl group; $R_{M6}$ represents an alkyl group, an aryl group, an alkoxy group, an aryloxy group, an alkylamino group or an arylamino group; $X_M$ represents a hydrogen atom, a halogen atom or a group capable of being released upon reaction with an oxidation product of a color developing agent.

In the foregoing formulas (M-1) and (M-1'), examples of the substituent represented by $R_{M1}$ include an alkyl group (e.g., methyl, ethyl propyl, isopropyl, t-butyl, pentyl, cyclopentyl, hexyl, octyl, dodecyl), cycloalkyl group, alkenyl group (e.g., vinyl, allyl), alkynyl group (e.g., propargyl), aryl group (e.g., phenyl, naphthyl), heterocyclic group (e.g., pyridyl, thiazolyl, oxazolyl, imidazolyl, furyl, pyrrolyl, pirazinyl, pyrimidinyl, selenazolyl, sulfolanyl, piperidinyl, pyrazolyl, tetrazolyl), halogen atom (e.g., chlorine, bromine, iodine, fluorine), alkoxy group (e.g., methoxy, ethoxy, propyloxy, pentyloxy, cyclopentyloxy, hexyloxy, cyclohexyloxy, octyloxy, dodecyloxy), aryloxy (e.g., phenoxy, naphthyloxy)alkoxycarbonyl (e.g., methyoxycarbonyl, ethyloxycarbonyl, butyloxycarbonyl, octyloxycarbonyl, dodecyloxycarbonyl), aryloxycarbonyl group (e.g., phenyloxycarbonyl, naphthyloxycarbonyl), sulfoneamido group (e.g., methylsulfonylamino, ethylsulfonylamino, butylsulfonylamino, hexylsulfonylamino, cyclohexylsulfonylamino, octylsulfonylamino, dedecylsulfonylamino, phenylsulfonylamino), sulfamoyl group (e.g., aminosulfonyl, methylaminosulfonyl, dimethylaminosulfonyl, butylaminosulfonyl, hexylaminosulfonyl, cyclohexylaminosulfonyl, octylaminosulfonyl, dpdecylaminosulfonyl, phenylaminosulfonyl, naphthylaminosulfonyl, 2-pyridylaminosulfonyl), ureido group (e.g., methylureido, ethylureido, pentylureido, cyclohexylureido, octylureido, dodecylureido, phenylureido, naphthylureido, 2-pyridylureido), acyl group (e.g., acetyl, ethylcarbonyl, propylcarbonyl, pentylcarbonyl, cyclohexylcarbonyl, octylcarbonyl, 2-ethylhexylcarbonyl, dedecylcarbonyl, phenyl carbonyl, naphthylcarbonyl, pyridylcarbonyl), carbamoyl group (e.g., aminocarbonyl, methylaminocarbonyl, dimethylaminocarbonyl, propylaminocarbonyl, pentylaminocarbonyl, cyclohexylaminocarbonyl, ocylaminocarbonyl, 2-ethylhexylaminocarbonyl, dodecylaminocarbonyl, phenylaminocarbonyl, naphthylaminocarbonyl, 2-pyridylaminocarbonyl), amido group (e.g., methylcarbonylamino, ethylcarbonylamino, dimethylcarbonylamino, propylcarbonylamino, pentylcarbonylamino, cyclohexylcarbonylamino, 2-ethylheylcarbonylamino, octylcarbonylamino, dodecylcarbonylamino, phenylcarbonylamino, naphthylcarbonylamino), sulfonyl group (methylsulfonyl, ethylsulfonyl, butylsulfonyl, cyclohexylsulfonyl, 2-ethyhexylsulfonyl, dodecysulfonyl, phenylsulfonyl, naphthylsulfonyl, 2-pyridylsulfonyl), amino group (e.g., amino, ethylamino, dimetylamino, butylamino, cyclopentylamino, 2-ethylhexylamino, dedecylamino, anilino, naphtylamino, 2-pyridylamino), cyano group, nitro group, sulfo group, carboxyl group, and hydroxyl group. The foregoing groups may be substituted. Of the foregoing groups are preferred alkyl, cycloalkyl, alkenyl, aryl, acylamino, sulfonamido, alkylthio, arylthio, halogen atom, heterocycle, sulfonyl, sulfinyl, phosphonyl, acyl, carbamoyl, sulfamoyl, cyano, alkoxy, aryloxy, acyloxy, aminoalkylamino, ureido, alkoxycarbonyl, aryloxycarbonyl, and carbonyl groups. Further, an alkyl group is more preferred and t-butyl group is specifically preferred.

In the formulas (M-1) and (M-1'), alkyl groups represented by $R_{M2}$ to $R_{M5}$ and $R_{M7}$ include straight chain or branche alkyl group (such as methyl, ethyl, i-propyl, t-butyl, 2-ethylhexyl, dodecyl, and 1-hexylnonyl, which may be substituted by substituents as cited in the foregoing $R_{M1}$. The alkyl group represented by $R_{M2}$ and $R_{m3}$ is preferably methyl. $R_{M7}$ is preferably a hydrogen atom.

Examples of an alkyl group, an aryl group, an alkoxy group, an aryloxy group, an alkylamino group or an arylamino group, represented by $R_{M6}$ include those of an alkyl group, an aryl group, an alkoxy group, an aryloxy group, an alkylamino group or an arylamino group represented by $R_{M1}$ described above.

Halogen atoms represented by $X_M$ include a chlorine atom, bromine atom, iodine atom and fluorine atom. Examples of the group capable of being released upon reaction with an oxidation product of a color developing agent include alkoxy, aryloxy, sulfonyloxy, alkoxycarbonyloxy, aryloxycarbonyloxy, alkyloxalyloxy, alkoxyoxalyloxy, alkylthio, arylthio, heterocyclic-thio, alkyloxycarbonylthio, acylamino, sulfonamido, N-bonded nitrogen-containing heterocyclic group, alkyloxycarbonylamino, aryloxycarbonylamino, and carboxyl groups. Of these groups, a halogen atom is preferred and a chlorine atom is specifically preferred.

Of magenta dye forming couplers represented by the foregoing formula (M-1) or (M-1'), the magenta dye forming coupler of the formula (M-1) is preferred and a magenta coupler represented by the following formula (M-2) is more preferred:

formula (M-2)

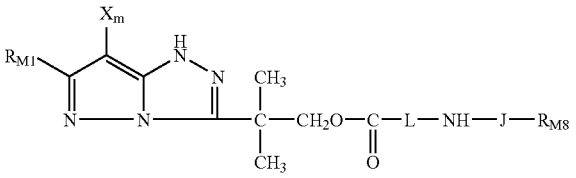

wherein $R_{M1}$ and $X_M$ are the same as defined in $R_{M1}$ and $X_M$ of the foregoing formula (M-1); $R_{M8}$ represents analkyl group, cycloalkyl group, or aryl group; L represents an alkylene group; J represents —(C═O)— or —(O═S═O)—.

The alkyl group represented by $R_{M1}$ is preferably one having 1 to 32 carbon atoms, such as methyl, ethyl, propyl, iosopropyl, t-butyl, hexyl, octyl, dodecyl, hexadecyl, and 2-ethylhexyl. The alkyl group represented by $R_{M1}$ may be substituted and substituents thereof include those as cited in $R_{M1}$ of the formula (M-1). The cycloalkyl group represented by $R_{M1}$ is preferably one having 3 to 12 carbon atoms, such as cyclopropyl, cyclopentyl, cyclohexyl, 2-methylcyclopropyl, and adamantyl. The cycloalkyl group represented by $R_{M1}$ may be substituted and substituents thereof include those as cited in $R_{M1}$ of the formula (M-1). The aryl group represented by $R_{M1}$ is preferably one having 6 to 14 carbon atoms, such as phenyl, 1-naphthyl and 2-naphthyl. The aryl group represented by $R_{M1}$ may be substituted and substituents thereof include those as cited in $R_{M1}$ of the formula (M-1)

In the formula (M-2), L represents an alkylene group, including methylene, ethylene, trimethylene and tetramethylene. The alkylene group may be substituted and substituents thereof include those as cited in $R_{M1}$ of the formula (M-1). Representative examples of the alkylene group represented by L are shown below but are not limited to these.

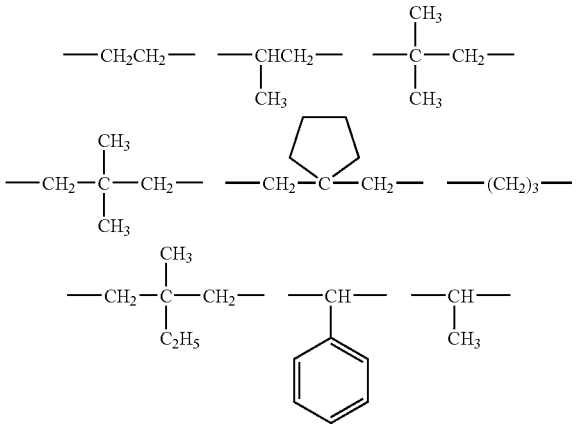

-continued

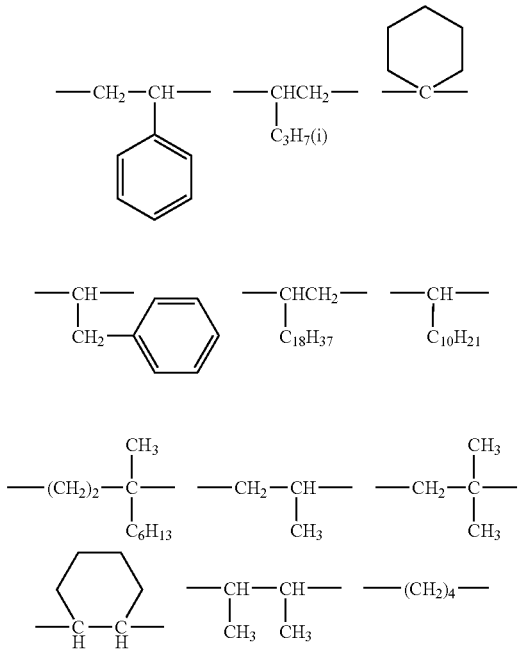

In the foregoing formula (M-2), L is preferably an ethylene group, and specifically preferably unsubstituted ethylene; J represents —(C═O)— or —(O═S═O)—. Specific examples of magenta dye forming couplers represented by the foregoing formula (M-1) or (M-1') are exemplarily described in JP-A No. 2000-147725, including exemplified compounds M-1 through M1-57.

Some examples of the compound of formula (M-1) or (M-1') are shown below.

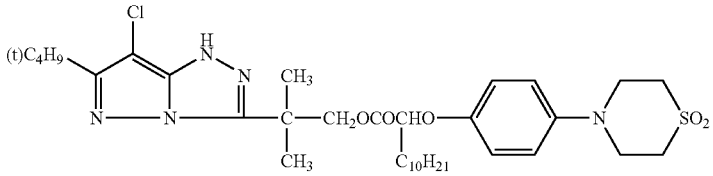

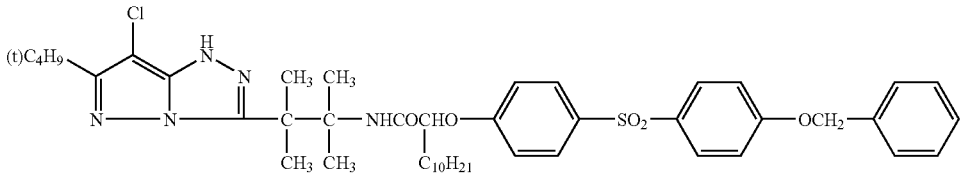

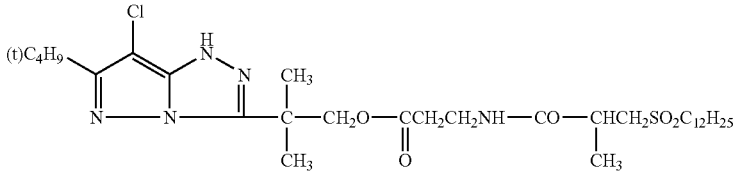

-continued

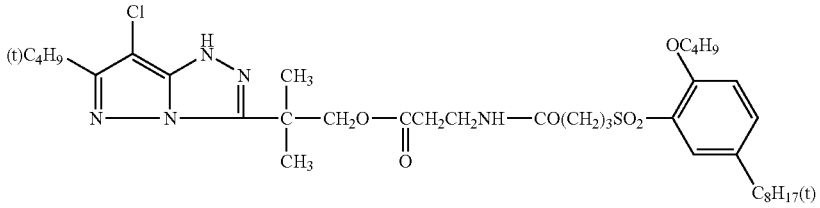

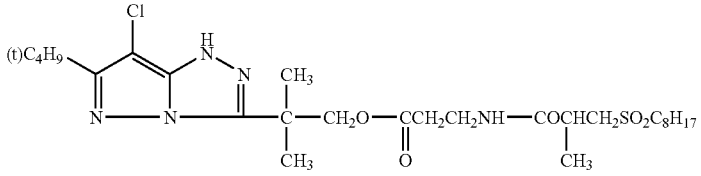

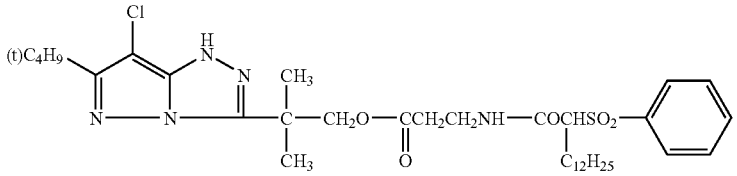

Magenta dye forming couplers represented by the foregoing formulas (M-1) and (M-1') can be readily synthesized with reference to methods described in Journal of Chemical society, Perkin I (1977) 2047–2053; U.S. Pat. No. 3,725,067; JP-A No. 59-99437, 58-42405, 59-162548, 59-171956, 60-33552, 60-43659, 60-172982, 60-190779, 61-189539, 61-241754, 63-163351, 62-157031; Syntheses, 1981, page 40, ibid 1984, page 122, ibid 1984, page 894; JP-A 49-53574, 7-175186; Research Disclosure 40376 (1997, November) page 839–84; British Patent No. 1,410,846, "Shin-Jikkenkagaku Koza 14-III", page 1584–1594 (published by Maruzen); Helv. Chem. Acta. 36, 75 (1953); J Am. Chem. Soc., 72, 2762 (1950); Org. Synth., vol. II, 395 (1943).

The magenta dye forming coupler of the foregoing formula (M-1) or (M-1') is usually used at $1\times10^{-2}$ to $1\times10^{-1}$ mol per mol of silver halide. This coupler may be used in combination with other couplers.

The color reversal photographic material according to this invention preferably contains a compound represented by the following formula (1), (2) or (3):

formula (1)

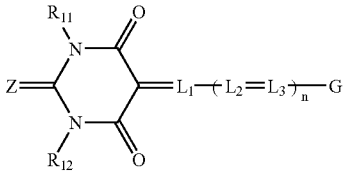

wherein Z represents an oxygen atom or sulfur atom; $L_1$, $L_2$ and $L_3$, each represents a methine group; n is 0, 1 or 2; G represents a heterocyclic group or an aromatic hydrocarbon group; $R_{11}$ and $R_{12}$, each represents a hydrogen atom or a substituent, provided that at least one of $R_{11}$ and $R_{12}$ is $-A_1$-COOH, in which $A_1$ is a bivalent aliphatic group;

formula (2)

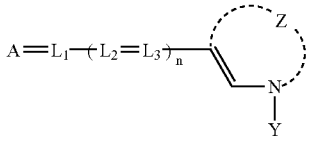

wherein A represents an acidic nuclear; $L_1$, $L_2$ and $L_3$, each represents a methine group; n is 0, 1 or 2; Z represents an atomic group necessary to form a nitrogen containing aromatic heterocycle; Y represents —$C(R_1)(R_2)(R_3)$ or a heterocyclic group, in which $R_1$ and $R_2$ is a hydrogen atom or an alkyl group, or $R_1$ and $R_2$ may combine with each other to form a ring, and $R_3$ is a hydrogen atom or an electron-withdrawing group having a Hammett $\sigma_p$ value of 0.3 or more, provided that all of $R_1$, $R_2$ and $R_3$ are not hydrogen atoms at the same time; and the compound represented by formula (2) contains a carboxy or alkylsufoneamido group substituted on the aromatic heterocycle;

formula (3)

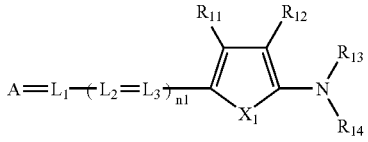

wherein A represents an acidic nuclear; $L_1$, $L_2$ and $L_3$, each represents a methine group; n is 0, 1 or 2; $X_1$ represents an oxygen atom, sulfur atom or selenium atom; $R_{11}$ and $R_{12}$ each represents a hydrogen atom or an alkyl group, provided that $R_{11}$ and $R_{12}$ may combine with each other to form a ring; $R_{13}$ and $R_{14}$ each represents an alkyl group.

In the foregoing formula (1), Z is an oxygen atom or sulfur atom, and preferably an oxygen atom. $R_{11}$ and $R_{12}$, each represents a hydrogen atom or a substituent. Examples of the substituent represented by $R_{11}$ and $R_{12}$ include a chain or cyclic alky group having 1 to 8 carbon atoms (e.g., methyl, ethyl, i-propyl, butyl, butyl, hexyl, cyclopropyl, cyclohexyl, 2-hydroxyetyl, 4-carboxybutyl, 2-methoxyethyl, benzyl, phenethyl, 4-carboxybenzyl, 2-diethylaminoethyl), alkenyl group having 2 to 8 carbon atoms (e.g., vinyl, acryl), alkoxy group having 1 to 8 carbon atoms (e.g., methoxy, ethoxy, propoxy, butoxy), halogen atom (e.g., fluorine, chlorine, bromine), amino group having 0 to 10 carbon atoms (e.g., amino, dimethylamino, diethylamino, carboxyethylamino), ester group having 2 to 10 carbon atoms (e.g., methoxycarbonyl, ethoxycarbonyl), amido group having 1 to 10 carbon atoms (e.g., acetylamino, benzamido), carbamoyl group having 1 to 10 carbon atoms (e.g., carbamoyl, methylcarbamoyl, ethylcarbamoyl), aryl group having 6 to 10 carbon atoms (e.g., phenyl, naphthyl, 4-carboxyphenyl, 3-carboxyphenyl, 3,5-dicarboxyphenyl, 4-methanesulfoneamodophenyl, 4-butanesulfoneamidophenyl), aryloxy group having 6 to 10 carbon atoms (e.g., phenoxy, 4-carboxyphenoxy, 4-methylphenoxy, naphthoxy), alkylthio group having 1 to 8 carbon atoms (e.g., methylthio, ethylthio, octylthio), acyl group having 1 to 10 carbon atoms (e.g., acetyl, benzoyl, propanoyl, pivaloyl), sulfonyl group having 1 to 10 carbon atoms (e.g., methanesulfonyl, benzenesulfonyl), ureido group having 1 to 10 carbon atoms (e.g., ureido, methylureido), urethane group having 2 to 10 carbon atoms (e.g., methoxycarbinylamino, ethoxycarbonylamino), cyano group, hydroxy group, nitro group, and heterocyclic group (e.g., 5-carboxybenzoxazole, pyridine, sulfolane, furan, pyrrole, pyrrolidine, morpholine, piperazine and pyrimidine residues). Of these, a hydrogen atom, alkyl group, alkoxy group, aryl group, ester group, halogen atom, cyano group, and hydroxy group are preferred; and a hydrogen atom, alkyl group and aryl group are more preferred. Provided that at least one of $R_{11}$ and $R_{12}$ is $-A_1$-COOH, in which $A_1$ is a bivalent aliphatic group. The aliphatic group represented by $A_1$ is preferably an alkylene group, and more preferably methylene, ethylene or propylene.

G represents a heterocyclic group (e.g., moiety of oxazole, benzoxazole, thiazole, imidazole, pyridine, furan, thiophene, sulfolane, pyrazole, pyrrole, chroman, or coumalin) or an aromatic hydrocarbon group (e.g., phenyl., naphthyl), which may be substituted. G is preferably thienyl, thiazolyl or furanyl.

The methine group represented by $L_1$, $L_2$ and $L_3$ may be substituted, and substituents thereof are those described in $R_{11}$ and $R_{12}$; and n is 0, 1 or 2, preferably 0 or 1, and more preferably 0.

The foregoing compound represented by formula (1) can be used in combination with a compound represented by formula (2) described later, whereby satisfactory absorption waveform for a yellow filter layer can be achieved, leading to superior color reproduction.

Specific examples of the compound represented by the formula (1) are shown below but are by no means limited to these.

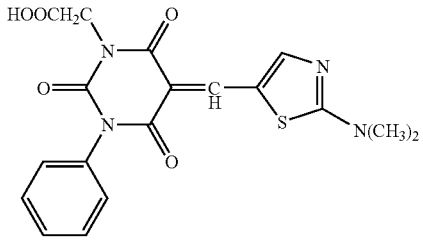

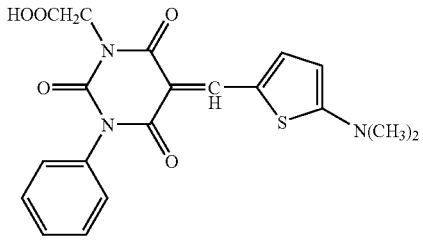

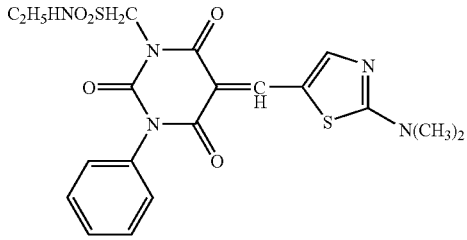

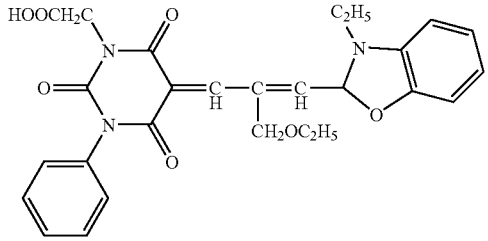

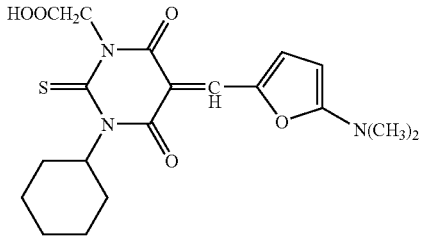

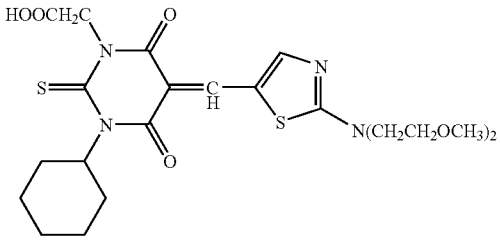

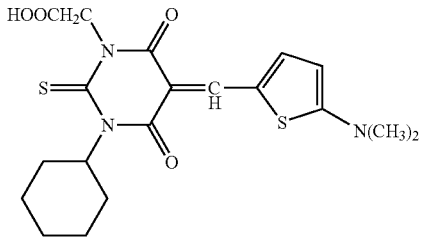

-continued

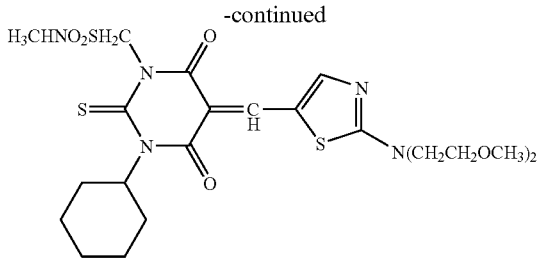

In the formula (2), examples of an acidic nuclear represented by A include 2-pyrazoline-5-one, pyrazolidinedione, barbituric acid, thiobarbituric acid, rhodanine, hydantoin, thiohydantoin, oxazoline, isooxazolone, indanedione, hydroxypyridine, and pyrazolopyridone. Of these, 2-pyrazoline-5-one is preferred. The acidic group may be substituted. Examples of substituents include an alkyl group methyl, ethyl hexyl), cycloalkyl group (e.g., cyclohexyl, cyclopentyl), aryl group (e.g., phenyl tolyl, 4-hydroxyphenyl, 4-carboxyphenyl), aralkyl group (e.g., benzyl, phenethyl), alkoxy group (e.g., methoxy, ethoxy, t-butoxy), aryloxy group (e.g., phenoxy, 4-methylphenoxy), a heterocyclic group (e.g., pyridyl, furyl, thienyl), amino group (e.g., dimethylamino, diethylamino, anilino), alkylthio group (e.g., methylthio), acyl group (e.g., acetyl, pivaloyl, benzoyl9, alkoxycarbonyl group (e.g., methoxycarbonyl, ethoxycarbonyl, 20hydroxyethoxycarbonyl), carbamoyl group (e.g., carbamoyl, methylcarbamoyl, ethylcarbamoyl, 2-hydroxyethylcarbamoyl, dimethylcarbamoyl, 4-carboxyphenylcarbamoyl) and cyano group.

In the formula (2), it is well known in the art where the acidic nuclear links with $L_1$ so that the resulting compound of the formula (2) functions as a dye. It can also be experimentally confirmed.

Methine groups represented by $L_1$, $L_2$ and $L_3$ may be substituted and examples of substituents are the same as described in the acidic nuclear A; n is 0, 1 or 2, preferably 0 or 1, and more preferably 0.

Examples of heterocyclic rings formed by Z together with nitrogen atom include pyrrole, pyrazole, imidazole, triazole and tetrazole. The heterocyclic group may be condensed with a benzene ring. Such a heterocyclic rings include, for example, indole, indazole and benzimidazole. The heterocyclic ring may be substituted and examples of substituents are those described in the foregoing acidic nuclear A and halogen atoms.

Y represents —$C(R_1)(R_2)(R_3)$ or a heterocyclic group. Examples of the heterocyclic group include pyrrole, imidazole, pyrazole, pyridine, pyrimidine, thiophene, quinoline, benzimidazole, indole, benzthiazole, sulfolane, thiacyclohexane-1,1-dioxide, butyrolactone, pyrane, morpholine and piperidine. The heterocyclic ring may be substituted and examples of substituents are those described in the foregoing acidic nuclear A and halogen atoms. $R_1$ and $R_2$ are each an alkyl group, such as methyl, ethyl, isopropyl, butyl, neopentyl, or octyl, and preferably methyl or ethyl. $R_1$ and $R_2$ may combine with each other to form a ring, such as cyclohexane, cyclopentane, cyclohexane or cyclohexanone. The alkyl group or the formed ring may be substituted and examples of substituents are those described in the foregoing acidic nuclear A and halogen atoms. $R_3$ is a hydrogen atom or an electron-withdrawing group having a Hammett $\sigma_p$ value of 0.3 or less [as described, for example, in Fujita, Toshio "Yakubutsu no Kozo-kasseisokan" (Drug structure-activity correlation) Kagakunoryoiki, No. 122, page 96–103 (Nankodo)]. Examples of such a group include cyano group, alkoxycarbonyl group (e.g., methoxycarbonyl, ethoxycarbonyl, butoxycarbonyl, octyloxycarbonyl), aryloxycarbonyl group (e.g., phenoxycarbonyl, 4-hydroxyphenoxycarbonyl), carbamoyl group (e.g., carbamoyl, methylcarbamoyl, ethylcarbamoyl, butylcarbamoyl, dimethylcarbamoyl, phenylcarbamoyl, 4-carboxyphenylcarbamoyl), acyl group (e.g., methylcarbonyl, ethylcarbonyl, butylcarbonyl, phenylcarbonyl, 4-ethylulfoneamidophenylcarbamoyl), alkylsulfonyl group (e.g., methylsulfinyl, ethylsulfinyl, butylsulfonyl, octylsulfonyl), and arylsulfonyl group (phenylsulfinyl, 4-chlorophenylsulfonyl). Of these, an alkoxycarbonyl group, alkylsulfonylamino group and trifluoromethyl and cyano are preferred. Provided that all of $R_1$, $R_2$ and $R_3$ are not hydrogens atoms at the same time.

Further, the compound represented by formula (2) contains, in the molecule, an aromatic ring having a carboxy group or an alkysulfoneamido group (e.g., methylsulfoneamido, ethylsulfoneamido), in which carboxy or methylsulfoneamido is preferred, and carboxy is more preferred.

Examples of the compound represented by formula (2) are described in JP-A 2000-275782 (exemplified compounds 1-1 through 1-60). Specific examples of the compound of formula (2) are also shown below.

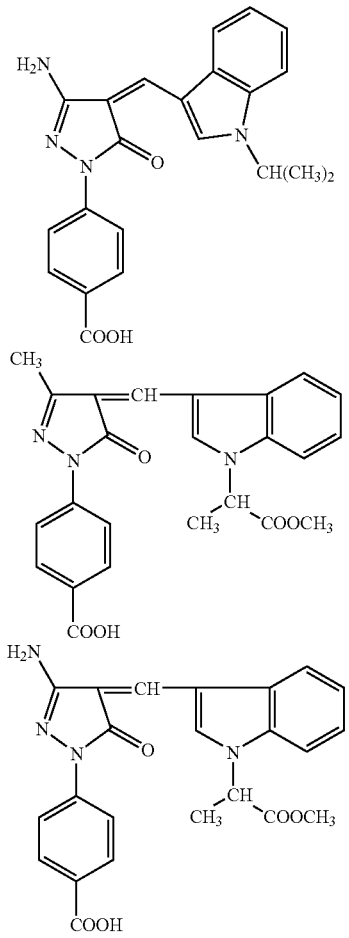

In the formula (3), examples of an acidic nuclear represented by A include 2-pyrazoline-5-one, pyrazolidinedione, barbituric acid, thiobarbituric acid, rhodanine, hydantoin, thiohydantoin, oxazoline, isooxazolone, indanedione, hydroxypyridine, and pyrazolopyridone. Of these, 2-pyrazoline-5-one is preferred. The acidic nuclear may be substituted.

Methine groups represented by $L_1$, $L_2$ and $L_3$ may be substituted and examples of substituents are the same as described in the acidic nuclear A; n is 0, 1 or 2, preferably 0 or 1, and more preferably 0.

$X_1$ is an oxygen atom, sulfur atom or selenium atom, preferably an oxygen atom or sulfur atom, and more preferably an oxygen atom.

$R_{11}$ and $R_{12}$, each represents a hydrogen atom or an alkyl group (preferably alkyl group having 1 to 8 carbon atoms, e.g., methyl, ethyl, hexyl, t-octyl), provided that $R_{11}$ and $R_{12}$ may combine with each other to form a ring. $R_{13}$ and $R_{14}$ each represent an alkyl group (preferably alkyl group having 1 to 6 carbon atoms, e.g., methyl, ethyl, t-butyl, hexyl).

The foregoing groups may be substituted. Examples of substituents include a halogen atom (e.g., chlorine, bromine, fluorine, iodine atoms), an alkoxy group (e.g., methoxy, ethoxy, 1,1-dimethylethoxy, n-hexyloxy, n-dodecyloxy), aryloxy group (e.g., phenoxy, naphthoxy), aryl group (e.g., phenyl, naphthyl), alkoxycarbonyl group (e.g., methoxycarbonyl, ethoxycarbonyl, n-butoxycarbonyl, 2-ethylhexyloxycarbonyl), aryloxycarbonyl group (e.g., phenoxycarbonyl, naphthyloxycarbonyl), alkenyl group (e.g., vinyl), alkynyl group (e.g., propargyl), heterocyclic group (e.g., 2-pyidyl, 3-pyridyl, 4-pyridyl, morpholyl, piperidyl, furyl), amino group (e.g., amino, N,N-dimethylamino, anilino), sulfonamido group (e.g., methylsulfonylamino, ethylsulfonylamino, n-butylsulfonylamino, n-octylsulfonylamino, phenylsulfonylamino), acyl group (e.g., acetyl, benzoyl, propanoyl, octanoyl), carbamoyl group (e.g., carbamoyl, N-methylcarbamoyl, N,N-diethylcarbamoyl, N-methanesulfonylcarbamoyl, N-acetylcarbamoyl), sulfonyl group (e.g., methanesulfonyl, trifluoromethanesulfonyl, benzenesulfonyl, p-toluenesulfonyl), sulfamoyl group (e.g., sulfamoyl, N,N-dimethylsulfamoyl, morpholinosulfamoyl, N-ethylsulfamoyl), acylamino group (e.g., acetoamide, trifluoroacetoamido, benzamido, thienocarbonylamino, benzenesulfonylamido), hydroxy group, cyano group, sulfo group, and carboxy group. These groups may further be substituted or may combine with each other to form a ring.

Examples of the compound represented by formula (3) are described in JP-A 2000-275782 (exemplified compounds 1-1 through 1-60). Specific examples of the compound of formula (2) are also shown below.

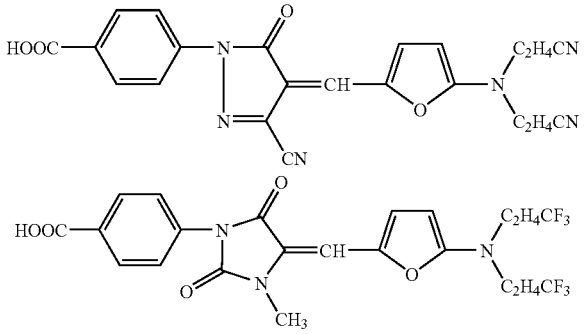

-continued

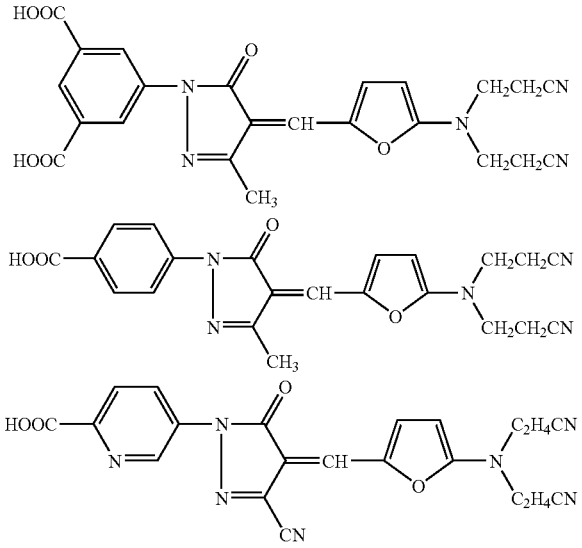

The compounds represented by formulas (1), (2) and (3) are used as a dye in this invention (which are hereinafter also denoted as a dye compound or simply as a dye). Such a dye compound may be incorporated through solution in water or organic solvents. Alternatively, the compound may be incorporated in the form of a fine solid particle dispersion using a sand mill, ball mill or impeller dispersion. The fine solid particle dispersion can be prepared according to methods described in JP-A No. 52-92716, 55-155350, 55-155351, 63-197943, 3-182743 and World Patent WO88/04794, specifically, using a fine-dispersing machine, such a ball mill, jet mill, or vibration mill, sand mill, roller mill, jet mill, or disc impeller mill. In cases where a dye dispersed in the form of fine solid particles is water-insoluble at a relatively low pH and soluble in water at a relatively high pH, after the dye is dissolved in alkaline aqueous solution, the pH of the solution is lowered to weak acidity to cause fine solids to precipitate. Alternatively, a weak alkaline solution of a dye and an acidic solution were simultaneously mixed with adjusting a pH to form a fine solid particle dispersion of the dye.

Fine solid particle dispersions of dyes relating to this invention may be used alone or in a mixture of thereof, or in combination with a solid particle dispersion of other dye. Two or more kinds of dyes may be dispersed singly, followed by being mixed, or may be simultaneously dispersed.

In cases when a fine solid particle dispersion of a dye relating to this invention is prepared in the presence of an aqueous medium, it is preferred that surfactants are concurrently used therein. Any surfactant can be used, including anionic surfactants, nonionic surfactants, cationic surfactants and amphoteric surfactants. Preferred surfactants include anionic surfactants such as alkylsulfonates, alkylbenzensulfonates, alkylnaphthalenesulfonates, alkylsulfate esters, sulfosuccinate esters, sulfoalkylpolyoxyethylene alkylphenyl ethers and N-acyl-N-alkyltaurine, and nonionic surfactants such as saponin, alkyleneoxide derivatives and saccharide alkyl esters. The foregoing anionic surfactants are specifically preferred. Specific examples of surfactants usable in this invention include compound No. 1 through 32 described in Japanese patent Application No. 5-277011, page 32–46.

An amount of an anionic surfactant and/or nonionic surfactant to be used in this invention, depending on the kind thereof or dispersing conditions of a dye used therein, is usually 0.1 to 2000 mg, preferably 0.5 to 1000 mg, and more, preferably 1 to 500 mg per g of dye. It is also preferred to use a dye at a concentration of 0.01% to 10% by weight, and more preferably 0.1% to 5% by weight. Surfactants may be added before start of dispersing or added after completion of dispersing, or the combination thereof is also feasible. Anionic surfactants or nonionic surfactants may be used alone or in combination, or the combined use of the anionic and nonionic surfactants is feasible.

Fine solid particle of the dye relating to this invention are dispersed preferably so as to have an average particle size of 0.01 to 5 μm, 0.01 to 1 μm, and more preferably 0.01 to 0.5 μm. Such a dispersion preferably has a coefficient of variation of particle size distribution of 50% or less, preferably 40% or less, and more preferably 30% or less. The coefficient of variation of particle size distribution is defined as follows:

(standard deviation of particle size)/(average particle size)×100.

The fine solid particle dispersion of a dye can be incorporated into a hydrophilic colloid used a binder in the component layer of the photographic material. Gelatin is advantageously used as a hydrophilic colloid and there are also used gelatin derivatives such as phenylcalbamoylated gelatin, aylated gelatin and phthalated gelatin; graft polymer comprising gelatin and an ethylenic monomer capable of polymerizing with gelatin; cellulose derivatives such as carboxymethyl cellulose, hydroxymethyl cellulose and cellulose sulfuric acid ester; hydrophilic synthetic polymers such as polyvinyl alcohol, partially oxidized polyvinyl acetate, polyacrylamide, poly-N,N-dimethylacrylamide, poly-N-vinyl pyrrolidone and polymethacrylic acid; agar, Arabic gum, alginic acid, albumin and casein. A hydrophilic colloid is incorporated into the fine solid particle dispersion of a dye preferably at 0.1 to 12%, and more preferably 0.5 to 8% by weight.

The dye dispersion described above may be incorporated into light-sensitive emulsion layers (lower emulsion layer, upper emulsion layer) or light-insensitive hydrophilic colloid layers such as protective layer, sublayer on the support and backing layer. The dye dispersion is incorporated preferably into a light-insensitive layer, and more preferably a light-insensitive layer between the blue-sensitive layer and green-sensitive layer.

Dyes relating to this invention are used preferably in an amount capable of displaying effects of this invention. The amount of a dye to be use depends on the kind of dyes and characteristics of the silver halide color reversal photographic material. Dyes are used preferably in an amount giving an optical density of 0.05 to 3.0, or 1 mg to 1 g, more preferably 5 to 800 mg, and still more preferably 10 to 500 mg per $m^2$ of photographic material. The dye relating to this invention is used in combination with YC (Yellow Colloidal silver), preferably in a ration of 5:95 to 95:5, more preferably 10:90 to 90:10, and still more preferably 20:80 to 80:29.

Hydrophilic colloid used as a binder in photographic component layers is preferably gelatin, of which coating amount is preferably 0.1 to 2.0 g per $m^2$ of photographic material. Gelatin which is used as hydrophilic colloid in silver halide color reversal photographic materials relating to this invention, is made from raw materials such as cow bone, calf skin and pig skin, including alkali-processed gelatin which has been subjected to liming and acid-processed gelatin which has been treated with hydrochloric acid. Manufacturing and properties of gelatin are detailed in, for example, Arthur Veis, Macromolecular chemistry of Gelatin, page 187–217 (1964, Academic press); T. H. James, The Theory of Photographic Process 4th ed., page 55 (1977, Macmillan); "Nikawa to Gelatin" (Nippon Nikawa Gelatin Kogyokumuai, 1987); "Shashinkogaku no Kiso, Gineneshashin" page 119–124 (Corona Publishing Co.). The jelly strength of gelatin (based on PAGI method) is preferably 250 g or more. The calcium content (based on PAGI method) of gelatin is preferably not more than 4000 ppm, and more preferably not more than 3000 ppm.

Gelatin can be hardened using hardening agents, and a swelling ratio of a coating layer and layer strength can be controlled by adjusting an amount of a hardening agent. Examples of such a hardening agent include organic hardeners such as aldehydes (e.g., formaldehyde, glyoxal, glutar aldehyde9, mucohalogeno-acid (e.g., mucochloric acid, mucophenoxychloric acid), epoxy compounds, active halogen compounds (e.g., 2,4-dichloro-6-hydroxy-s-triazine), active vinyl derivatives [e.g., 1,3,5-triacryloylhexahydro-s-triazine, bis(vinylsulfonyl)methyl ether, N,N'-methylenebis (vinylsulfonyl(propioamide))], ethyleneimines, carbodiimides, methanesulfonic acid esters, and isooxazoles; inorganic hardeners such as chromium alum; and polymeric hardeners described in U.S. Pat. Nos. 3,057,407, 3,396,029 and 4,161,407. These hardening agents can be used alone or in combination thereof.

Visible light absorbing dyes usable in light-insensitive component layers of the silver halide color reversal photographic material include fine particular colloidal silver such as yellow colloidal silver and magenta colloidal silver as well as water-soluble dyes, oil-soluble dyes, alkali-soluble dyes and dyes dispersed in the form of fine solid particles. Further, silver halide grains adsorbed with a sensitizing dye or desensitizing dye are also usable. There are usable at least one of the foregoing dyes or colloidal silver or combinations thereof. Commonly known water-soluble dyes used in conventional color photographic materials are usable in this invention. Preferred examples thereof include oxonol dyes, merocyanine dyes, benzilidene dyes, anthraquinone dyes, cyanine dyes, styryl dyes, azo dyes, and hemioxonol dyes, in which dyes containing an acidic group such as sulfo group or carboxy group are specifically preferred.

There can be employed silver halide emulsions that can be prepared by selecting optimal conditions with reference to JP-A No. 61-6643, 61-14630, 61-112142, 62-157024, 62-18556, 63-92942, 63-151618, 63-163451, 63-220238, 63-311244; Research Disclosure (hereinafter, also denoted simply as "RD") 38957, sect. I and III, and RD40145. When used in the color reversal photographic material relating to this invention, silver halide emulsions which have been subjected to physical ripening, chemical ripening or spectral sensitization are used. Additives used in such processes are described in RD 38957, sect. IV and V; and RD 40145, sect. XV. Photographic additives usable in this invention are also described in RD 38957 sect. II to X and RD 40145 sect. I to XIII.

The silver halide color reversal photographic material according to this invention is provided with red-, green- and blue-sensitive silver halide emulsion layers, each of which contains dye forming couplers. A dye formed of the coupler contained in the respective layers preferably has an absorption maximum of at least 20 nm apart from that of other layers. There are preferably used yellow dye forming couplers, magenta dye forming couplers and cyan dye forming couplers. Combinations of a yellow dye forming coupler and a blue-sensitive layer, a magenta dye forming coupler and a green-sensitive layer, and a cyan dye forming coupler and a red-sensitive layer are usually used but other combinations are also applicable in this invention. DIR compounds are also usable in this invention. Specific examples of DIR compounds include D-1 through D-34 described in JP-A No. 4- 114153. There are also usable DIR compounds described in, for example, U.S. Pat. Nos. 4,234,678, 3,227,554, 3,647,291, 3,598,993, 4,419,886, 3,933,500; JP-A No. 57-56837, 5-13239: U.S. Pat. Nos. 2,972,363, 2,070,266; RD 40145, sect. XIV. Specific examples of dye forming coupler usable in this invention are also described in RD 40145, sect. II.

Additives usable in the silver halide color reversal photographic material according to this invention can be incorporated through dispersion described in RD 40145, sect. VIII. The color reversal photographic material may be provided with a filter layer or an interlayer as described in the foregoing RD 38957 sect. XI. In the color reversal photographic material, various layer arrangements are applicable, including conventional layer order, reverse layer order and unit constitution.

Silver halide color reversal photographic materials relating to this invention can be processed using commonly known developers described in T. H. James, The Theory of Photographic Process 4th ed., page 291–334; Journal of American Chemical Society, vol. 73, 3, 100 (1951), in accordance with methods described in the foregoing RD38957 sect. XVII to XX, and RD 40145 XXII.

The color reversal photographic material according to this invention may be provided with a magnetic recording layer for imputing information regarding photographic materials, such as the kind, manufacturing number, maker's name and the emulsion number; information regarding camera-photographing, such as the picture-taking date and time, aperture, exposing time, climate, picture-taking size, the kind of camera, and the use of an anamorphic lens; information necessary for printing, such as the print number, selection of filter, favorite of customers and trimming size; and information regarding customers.

The magnetic recording layer is provided on the side opposite to photographic component layers. A sublayer, an antistatic layer (conductive layer), a magnetic recording layer and a lubricating layer are preferably provided on the support in this order. As fine magnetic powder are employed metal magnetic powder, iron oxide magnetic powder, Co-doped iron oxide magnetic powder, chromium dioxide magnetic powder and barium ferrite magnetic powder. The magnetic powder can be manufactured according to the known manner.

The optical density of the magnetic recording layer is desirably as low as possible, in terms of influence on photographic images, and is preferably not more than 1.5, more preferably not more than 0.2, and still more preferably not more than 0.1. The optical density can be measured using SAKURA densitometer PDA-65 (available from Konica Corp.). Thus, using a blue light-transmitting filter, light at a wavelength of 436 nm is allowed to enter perpendicular to the coating layer and light absorption due to the coating can be determined.

The magnetic susceptibility of the magnetic recording layer is preferably not less than $3\times10^{-2}$ emu per $m^2$ of photographic material. The magnetic susceptibility can be determined using a sample-vibrating type flux meter VSM-3, available from TOEI KOGYO in such a manner that after saturating a coating sample with a given volume in the coating direction by applying an external magnetic field of 1,000 Oe, the flux density at the time of allowing the external field to be decreased to 0, is measured and converted to the volume of the magnetic layer contained in 1 $m^2$ of the photographic material. When the magnetic susceptibility per $m^2$ of the transparent magnetic layer is less than $3\times10^{-2}$ emu, there occur problems in input and output of magnetic recording.

The thickness of the magnetic recording layer is preferably between 0.01 and 20 μm, more preferably 0.05 and 15 μm, and still more preferably 0.1 and 10 μm. As a binder of the magnetic recording layer are preferably employed vinyl type resin, urethane type resin and polyester type resin. It is also preferred to form a binder by coating an aqueous emulsion resin without the use of an organic solvent. The binder can be hardened by a hardener, thermal means or electron beam to adjust physical properties. Specifically, hardening with a poly-isocyanate type hardener is preferred. An abrasive can be contained in the magnetic recording layer for preventing clogging, and non-magnetic metal oxide particles, such as alumina fine particles are preferably employed.

Support of the photographic material include polyester films such as polyethylene terephthalate (PET) and polyethylene naphthalate (PEN), cellulose triacetate film, cellulose diacetate film, polycarbonate film, polystyrene film and polyolefin film. In particular, a high moisture containing polyester support is superior in recovery of roll-set curl after processing even when the support is thinned, as described in JP-A 1-244446, 1-291248, 1-298350, 2-89045, 2-93641, 2-181749, 2-214852, and 2-291135. In the invention, Pet and PEN are preferably employed as a support. There are also usable supports described in the foregoing RD 38957, sect. XV.

The photographic material according to the invention preferably has a conductive layer containing a metal oxide particles, such as ZnO, $V_2O_5$, $TiO_2$, $SnO_2$, $Al_2O_3$, $In_2O_3$, $SiO_2$, MgO, BaO or $MoO_3$. The metal oxide particles containing a small amount of oxygen deficiency or a heteroatom forming a donor to the metal oxide, which is high conductive, preferably employed. Specifically, the latter, which does not provide fog to the silver halide emulsion, is preferred. Binders used in the conductive layer or a sublayer are the same as those used in the magnetic recording layer. As a lubricating layer provided on the magnetic recording layer is coated a higher fatty acid ester, a higher fatty acid amide, polyorganosiloxane, a liquid paraffin or a wax.

The aspect ratio of a photographic image area is not limited and various types are employed, such as conventional 126 size of 1:1, a half-size of 1:1.4, 135 (standard) size of 1:1.5, hi-vision type of 1:1.8 and panorama type of 1:3.

When the photographic material according to the invention is used in a roll form, it is preferably contained in a cartridge. The most popular cartridge is a 135 format patrone. There are also employed cartridges proposed in Japanese Utility Model Application Opened to Public Inspection No. 58-67329 and 58-195236; JP-A 58-181035 and 58-182634; U.S. Pat. No. 4,221,479; JP-A 1-231045, 2-170156, 2-199451, 2-124564, 2-201441, 2-205843, 2-210346, 2-211443, 2-214853, 2-264248, 3-37645 and 3-37646; U.S. Pat. Nos. 4,846,418, 4,848,693 and 4,832,275. It is possible ally to "small-sized photographic roll film cartridge and film camera" disclosed in JP-A 5-210201.

EXAMPLES

The present invention will be further described based on examples but embodiment of the invention are by no means limited to these.

Example 1

On a subbed cellulose triacetate film support were coated the following layers containing composition in that order, as shown below, to prepare a multi-layered color reversal photographic material Sample No. 101. The coating amount of each component was represented in term of g/m$^2$, provided that the amount of silver halide or colloidal silver was converted to the silver.

| | |
|---|---|
| 1st Layer (Anti-Halation Layer) | |
| Black colloidal silver | 0.26 |
| UV absorbent (UV-1) | 0.3 |
| AF-1 | 0.03 |
| Oil | 0.45 |
| Gelatin | 2.18 |
| 2nd Layer (Interlayer-1) | |
| Oil-1 | 0.25 |
| Gelatin | 0.67 |
| 3rd Layer (Low-speed Red-Sensitive Layer) | |
| EM-1 (spectral sensitized with dye S-1, S-2 S-3 and chemically sensitized) | 0.68 |
| Coupler (C-1) | 0.17 |
| High boiling solvent O-1 | 0.04 |
| AF-1 | 0.07 |
| Gelatin | 1.24 |
| 4th Layer (Intermediate-speed Red-sensitive Layer) | |
| EM-2 (spectral sensitized with dye S-1, S-2 S-3 and chemically sensitized) | 0.54 |
| Coupler (C-1) | 0.35 |
| High boiling solvent O-1 | 0.09 |
| AF-1 | 0.03 |
| Gelatin | 0.74 |
| 5th Layer (High-speed Red-Sensitive Layer) | |
| EM-2 (spectral sensitized with dye S-1, S-2 S-3 and chemically sensitized) | 0.59 |
| Coupler (C-1) | 0.74 |
| High boiling solvent O-1 | 0.19 |
| AF-1 | 0.02 |
| Gelatin | 1.69 |
| 6th Layer (Interlayer-2) | |
| DM-1 | 0.07 |
| AS-1 | 0.21 |
| High boiling solvent O-1 | 0.26 |
| Gelatin | 0.89 |
| 7th Layer (Interlayer-3) | |
| Gelatin | 0.67 |
| 8th Layer (Low-speed Green-Sensitive Layer) | |
| EM-4 (spectral sensitized with dye S-4, S-5 and chemically sensitized) | 0.54 |
| Magenta coupler (M-1) | 0.11 |
| High boiling solvent O-1 | 0.03 |
| AF-1 | 0.07 |
| Gelatin | 1.24 |
| 9th Layer (Intermediate-speed Green-Sensitive Layer) | |
| EM-5 (spectral sensitized with dye S-4, S-5 and chemically sensitized) | 0.41 |
| EM-6 (spectral sensitized with dye S-4, S-5 and chemically sensitized) | 0.10 |
| Magenta coupler (M-1) | 0.20 |
| High boiling solvent O-1 | 0.06 |
| AF-1 | 0.01 |
| Gelatin | 0.67 |
| 10th Layer (High-speed Green-Sensitive Layer) | |
| EM-6 (spectral sensitized with dye S-4, S-5 and chemically sensitized) | 0.46 |
| EM-4 (spectral sensitized with dye S-4, S-5 and chemically sensitized) | 0.03 |
| Magenta coupler (M-1) | 0.44 |
| High boiling solvent O-1 | 0.13 |
| AF-1 | 0.01 |
| Gelatin | 0.90 |
| 11th Layer (Interlayer-5 Yellow Filter Layer) | |
| DY-1 | 0.13 |
| DY-2 | 0.08 |
| AS-1 | 0.20 |
| High boiling solvent O-1 | 0.25 |
| DS-1 | 0.01 |
| Gelatin | 0.98 |
| 12th Layer (Low-speed Blue-sensitive Layer) | |
| EM-7 (spectral sensitized with dye S-6, S-7 and chemically sensitized) | 0.27 |
| EM-8 (spectral sensitized with dye S-6, S-7 and chemically sensitized) | 0.07 |
| Coupler (Y-1) | 0.38 |
| High boiling solvent O-1 | 0.06 |
| AF-1 | 0.02 |
| Gelatin | 1.04 |
| 13th Layer (Intermediate-sped Blue-sensitive Layer) | |
| EM-7 (spectral sensitized with dye S-6, S-7 and chemically sensitized) | 0.09 |
| EM-8 (spectral sensitized with dye S-6, S-7 and chemically sensitized) | 0.09 |
| EM-9 (spectral sensitized with dye S-6, S-7 and chemically sensitized) | 0.04 |
| Coupler (Y-1) | 0.33 |
| High boiling solvent O-1 | 0.05 |
| Gelatin | 0.82 |
| 14th Layer (High-sped Blue-sensitive Layer) | |
| EM-8 (spectral sensitized with dye S-6, S-7 and chemically sensitized) | 0.23 |
| EM-9 (spectral sensitized with dye S-6, S-7 and chemically sensitized) | 0.23 |
| Coupler (Y-1) | 0.89 |
| High boiling solvent O-1 | 0.13 |
| Gelatin | 1.45 |
| 15th Layer: Second protective Layer | |
| Light-insensitive silver iodobromide emulsion having a mean grain size of 0.04 μm, containing 2 mol % iodide | 0.06 |
| AS-1 | 0.18 |
| UV absorvent (U-1) | 0.5 |
| UV absorvent (U-2) | 0.11 |
| High boiling solvent O-1 | 0.22 |
| Gelatin | 2.27 |
| 16th Layer (First Protective Layer) | |
| PM-1 | 0.07 |
| PM-2 | 0.02 |
| WAX-1 | 0.02 |
| Gelatin | 0.55 |

In addition to the above composition were added coating aids containing surfactants SA-1 and SA-2; antiseptic DI-1, water-soluble dyes to adjust sensitivity F-1, F-2 and F-3, and additives DS-2, DS-3, DS-4, DS-5, DS-6, SC-1, SC-2 and F-4.

The chemical structure of the above composition is shown below.
U-1
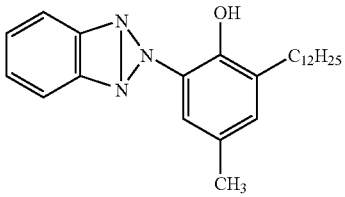
U-2
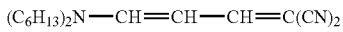
AF-1
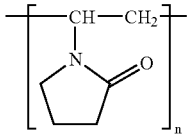
Mean M.W. = 100,000
Oil-1
Liquid paraffin
C-1
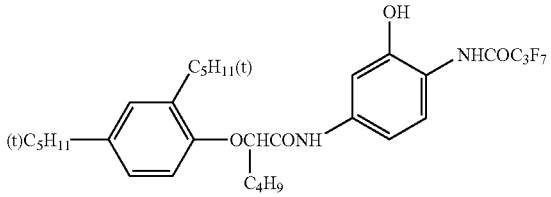
M-1
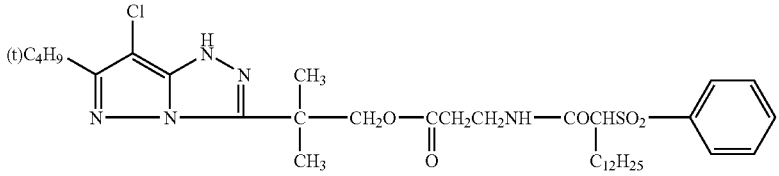
M-2
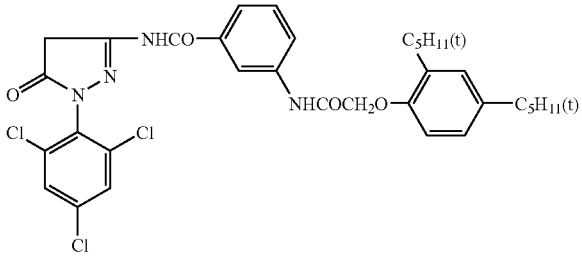
Y-1
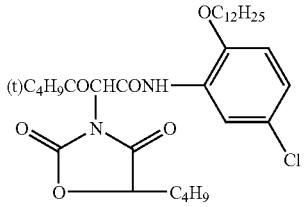
O-1
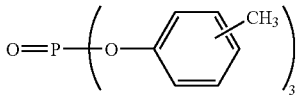
AS-1
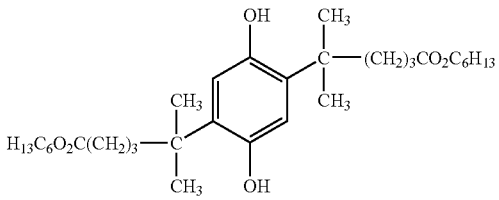
A
DM-1(Mixture, molar ratio A:B = 4:6)
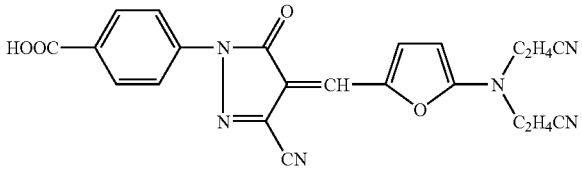
B
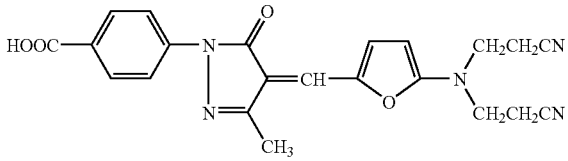

-continued
DY-1
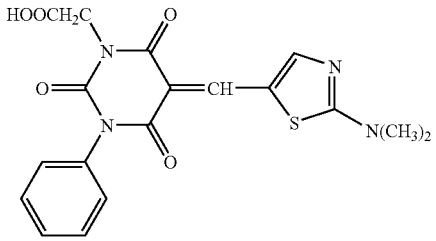
DY-2
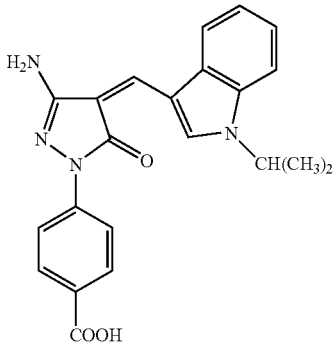
DS-1
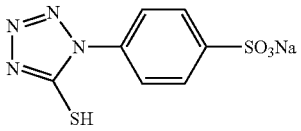
H-1
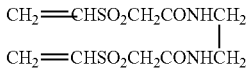
SA-1
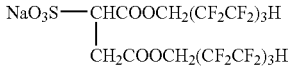
SA-2
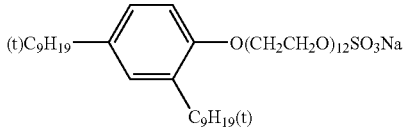
DI-1
(Mixture)
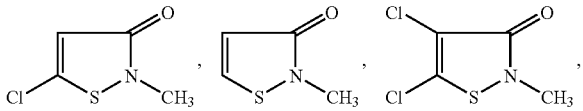
PM-1
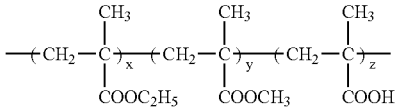
x:y:z = 3:3:4
PM-2
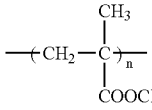
n: degree of polymerization
WAX-1
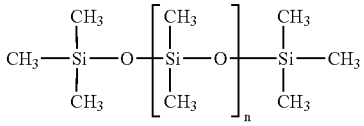
Mw = 3,000
SC-1
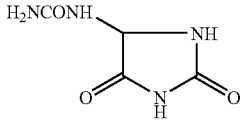
SC-2
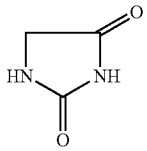
F-1
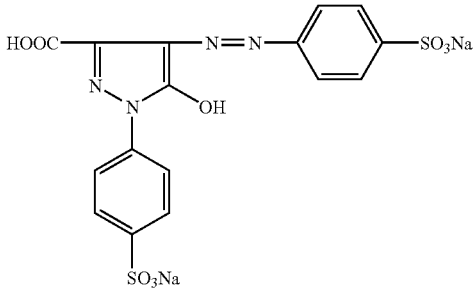
F-2
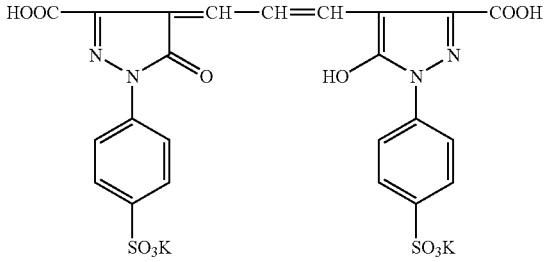

-continued
F-3
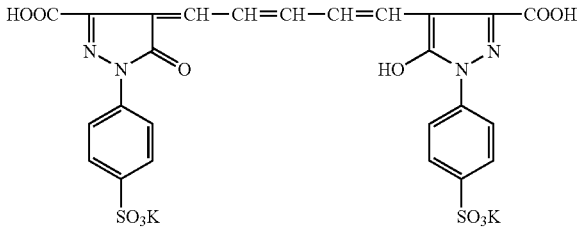
F-4
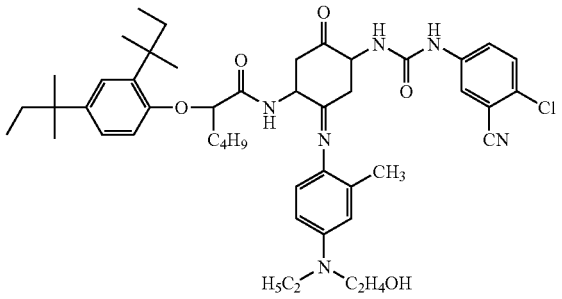
DS-2
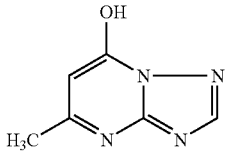
DS-3
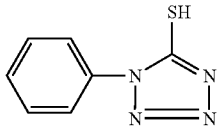
DS-4
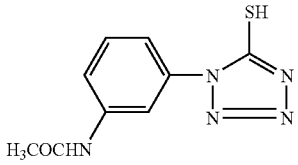
DS-5
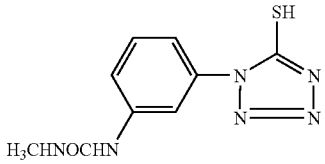
DS-6
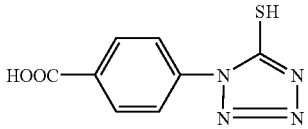
S-1
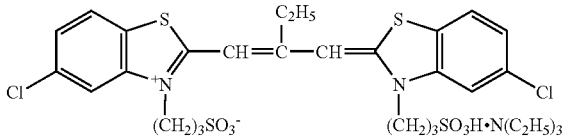
S-2
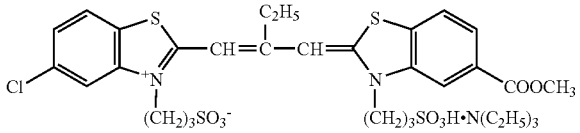
S-3
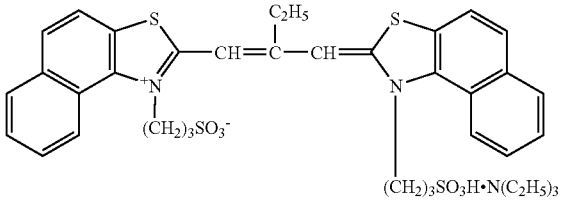
S-4
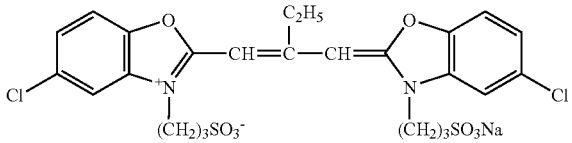
S-5
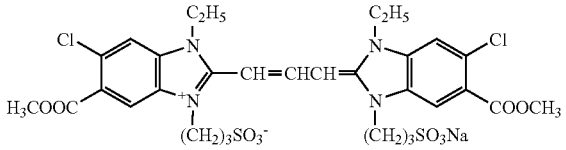
S-6
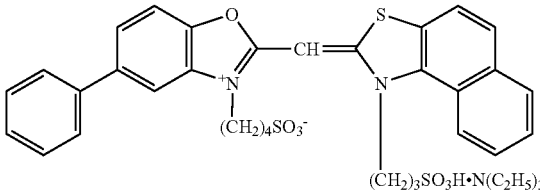
S-7
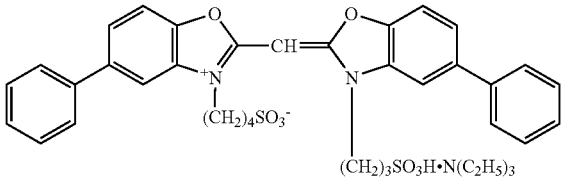

Sample No. 102 was prepared similarly to Sample No. 101, except that coating amounts of emulsions EM-3 of the 5th layer, EM-6 of the 10th layer and EM-8 of the 14th layer each increased by 15%.

Sample No. 103 was prepared similarly to Sample No. 102, except that emulsion EM-1 of the 3rd layer was replaced by EM-10 which was spectrally sensitized with the same sensitizing dyes as EM-1 and chemically sensitized, emulsion EM-4 of the 8th layer was replaced by EM-11 which was spectrally sensitized with the same sensitizing dyes as EM-4 and chemically sensitized, and emulsion EM-7 of the 12th layer was replaced by EM-12 which was spectrally sensitized with the same sensitizing dyes as EM-7 and chemically sensitized.

Sample No. 104 was prepared similarly to Sample No. 103, except that emulsion EM-10 was replaced by EM-13 and EM-11 of the 8th layer was replaced by EM-14. Emulsion EM-13 was the same as EM-10, except that compound (R-1) of 10 mg/mol Ag was further added thereto, and EM-14 was the same as EM-11, except that compound (R-1) of 15 mg/mol Ag was further added thereto.

Characteristics of emulsions EM-1 through EM-12 are shown below.

TABLE 1

| Emulsion | Average Grain Size (μm) | Shape | Average Aspect Ratio | Average Iodide Content (mol %) |
|---|---|---|---|---|
| EM-1 | 0.25 | Tabular | 6 | 4 |
| EM-2 | 0.42 | Cubic | — | 3 |
| EM-3 | 0.52 | Tabular | 8 | 2 |
| EM-4 | 0.25 | Tabular | 6 | 3.2 |
| EM-5 | 0.4 | Cubic | — | 3 |
| EM-6 | 0.52 | Tabular | 8 | 2.5 |
| EM-7 | 0.3 | Tabular | 5 | 3.5 |
| EM-8 | 0.65 | Cubic | 7 | 2 |
| EM-9 | 1.10 | Tabular | 7 | 2 |
| EM-10 | 0.25 | Cubic | — | 4 |
| EM-11 | 0.25 | Cubic | — | 3.2 |
| EM-12 | 0.36 | Cubic | — | 3.5 |

Samples 101 to 104 were exposed through an optical wedge for 1/100 sec. using a light source of 5400K and subjected to color reversal processing according to the process described below to evaluate speed and contrast. It was proved that all samples exhibited an almost identical ISO speed of more than 80. Contrast was evaluated with respect to γh and γs, and interimage effect characteristic value |IIEh|/|IIEs|, as defined in this invention was determined. Results are shown in Table 2.

TABLE 2

| Sample No. | γh | γs | \|IIEh\|/\|IIEs\| | Remark |
|---|---|---|---|---|
| 101 | 1.05 | 1.77 | 1.13 | Comp. |
| 102 | 1.07 | 2.02 | 0.95 | Comp. |
| 103 | 1.22 | 2.02 | 1.05 | Inv. |
| 104 | 1.18 | 1.98 | 1.17 | Inv. |

Further, Sample Nos. 101 through 104 were each cut to Brownie size (i.e., 120 film size) and practical picture tests were conducted selecting photographing scenes such as woods and autumn-tinted leaves. The thus obtained color reversal photographic images were visually evaluated with respect to impression of sharpness by five examiners. Evaluation was made based on the following criteria:

5: images were extremely satisfied and even texture was expressed,

4: images were satisfied and no defect was noticed,

3: contrast and color reproduction were superior,

2: contrast and color reproduction were unsatisfactory,

1: images apparently had defects.

The evaluation was based on average value of the foregoing evaluation results by five examiners, as follows:

AA: average of 4.6 to 5.0,

A: average of 4.0 to 4.5,

B: average of 3.0 to 3.9,

C: average value of 1.0 to 2.9.

In the foregoing, AA and A were acceptable in practical use. Results are shown in Table 3

TABLE 3

| Sample No. | Visual Evaluation |
|---|---|
| 101 | C |
| 102 | B |
| 103 | A |
| 104 | AA |

Process

| Step | Temperature | Time |
|---|---|---|
| First developing | 6 min. | 38° C. |
| Washing | 2 min. | 38° C. |
| Reversal | 2 min. | 38° C. |
| Color developing | 6 min. | 38° C. |
| Adjusting | 2 min. | 38° C. |
| Bleaching | 6 min. | 38° C. |
| Fixing | 4 min. | 38° C. |
| Washing | 4 min. | 38° C. |
| Stabilizing | 1 min. | Ord. temp. |
| Drying | | |

Processing solutions used in the above steps are as follows.

| | |
|---|---|
| First Developer Solution | |
| Sodium tetrapolyphosphate | 2 g |
| Sodium sulfite | 20 g |
| Hdroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water was added to make 1000 ml (and pH of 9.60). | |
| Reversal Solution | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| Color Developer Solution | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |

-continued

| | |
|---|---|
| 2,2-Ethylendithioethanol | 1 g |
| Water to make 1000 ml (pH of 11.70) | |
| Conditioner | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| Bleaching Solution | |
| Sodium ethylenediaminetertaacetate (dihydrate) | 2 g |
| Ammonium ferric ethylenediaminetertaacetate (dihydrate) | 120 g |
| Potassium bromide | 100 g |
| Water to make 1000 ml (pH of 5.56) | |
| Fixer Solution | |
| Ammonium thiosulfate | 80 g |
| Sodium bisulfite | 5 g |
| Sodium bisulfite | 5 g |
| Water to make 1000 ml (pH o 6.60) | |
| Stabilizer Solution | |
| Formalin (37 wt %) | 5 ml |
| KONIDUCKS (available from Konica Corp.) | 5 ml |
| Water to make 1000 ml (pH of 7.00). | |

Example 2

Color reversal photographic material Samples No. 201 through 204 were prepared similarly to Sample No. 101 in Example 1, except that emulsion EM-6 of the 10th layer was replaced by silver halide tabular grain emulsions (as shown in Table 4), EM-15, EM-16, EM-17 and EM-18, respectively. Similarly to Example 1, the thus prepared samples were evaluated with respect to γh, γs and |IIEh|/|IIEs|. Samples were further evaluated with respect to RMs granularity at a magenta density of 1.0. Granularity was represented by a relative value, based on the granularity of Sample No. 103 being 100. Results are shown in Table 5

TABLE 4

| Emulsion | Average Grain Size (μm) | Average Aspect Ratio | Average Iodide content (mol %) | Average Iodide content of Host Grains*1 | Dislocation Line*2 |
|---|---|---|---|---|---|
| EM-6 | 0.52 | 8 | 2.5 | 0 | 70 |
| EM-15 | 0.52 | 8 | 2.5 | 1.7 | 55 |
| EM-16 | 0.52 | 7 | 3 | 2.2 | 52 |
| EM-17 | 0.6 | 8 | 3 | *3 | — |
| EM-18 | 0.5 | 7 | 4.5 | 2.2 | 65 |

*1Host grains before introducing dislocation lines
*2Percentage of grains containing at least 10 dislocation lines, based on grain projected area
*3 No dislocation line was introduced.

TABLE 5

| Sample No. | Emulsion (10th Layer) | γh | γs | \|IIEh\|/\|IIEs\| | Granularity |
|---|---|---|---|---|---|
| 103 | EM-6, EM-4 | 1.22 | 2.02 | 1.05 | 100 |
| 201 | EM-15, EM-4 | 1.20 | 2.00 | 1.08 | 110 |
| 202 | EM-16, EM-4 | 1.18 | 1.97 | 1.03 | 120 |
| 203 | EM-17, EM-4 | 1.15 | 2.04 | 1.03 | 138 |
| 204 | EM-18, EM-4 | 1.17 | 1.98 | 1.08 | 130 |

As can be seen from Table 5, Samples No. 103 and Nos. 201 through 204 each meets the requirements regarding γh, γs and |IIEh|/|IIEs|. It is further noted that from comparison of Samples No. 202 and 204, the use of silver halide grains having a lower iodide content resulted in superior granularity; from comparison of Sample No. 103, 201 and 202, the use of host grains prior to introduction of dislocation lines, having a lower iodide content before also resulted in superior granularity; and from comparison of Sample No. 202 and 203, the use of silver halide grains having dislocation lines resulted in superior granularity.

Example 3

Sample No. 301 was prepared similarly to Sample No. 103 in Example 1, except that dye forming coupler M-1 used in the 8th, 9th and 10th layers was replaced by coupler M-2 and compositions of the 8th, 9th and 10th layers were varied as described below, and provided that amounts of water-soluble dyes F-1, F-2 and F-3 were adjusted so that the speed of Sample No. 301 was equivalent to that of Sample No. 103.

| | |
|---|---|
| 8th Layer (Low-speed Green-Sensitive Layer) | |
| EM-11 (spectral sensitized with dye S-4, S-5 and chemically sensitized) | 0.54 |
| Magenta coupler (M-2) | 0.21 |
| High boiling solvent O-1 | 0.03 |
| AF-1 | 0.07 |
| Gelatin | 1.90 |
| 9th Layer (Intermediate-speed Green-Sensitive Layer) | |
| EM-5 (spectral sensitized with dye S-4, S-5 and chemically sensitized) | 0.41 |
| EM-6 (spectral sensitized with dye S-4, S-5 and chemically sensitized) | 0.10 |
| Magenta coupler (M-2) | 0.38 |
| High boiling solvent O-1 | 0.06 |
| AF-1 | 0.01 |
| Gelatin | 0.95 |
| 10th Layer (High-speed Green-Sensitive Layer) | |
| EM-6 (spectral sensitized with dye S-4, S-5 and chemically sensitized) | 0.53 |
| EM-4 (spectral sensitized with dye S-4, S-5 and chemically sensitized) | 0.03 |
| Magenta coupler (M-2) | 0.74 |
| High boiling solvent O-1 | 0.11 |
| AF-1 | 0.01 |
| Gelatin | 1.31 |

Similarly to Example 1, the sample was evaluated with respect to γs, γh and |IIEh|/|IIEs|. Results thereof are shown in Tble 6. Further, according to the method described in JP-A No. 2001-264942, color reproducibility was tested with respect to red, blue and green charts, using Macbeth color chart. The thus obtained results regarding chroma are shown in Table 6. The chroma is represented by a relative value, based on that of Sample 103 regarding the respective colors being 100.

TABLE 6

| Sample | | | | Chroma | | |
|---|---|---|---|---|---|---|
| No. | γh | γs | \|IIEh\|/\|IIEs\| | Red | Blue | Green |
| 103 | 1.22 | 2.02 | 1.05 | 100 | 100 | 100 |
| 301 | 1.17 | 2.03 | 1.03 | 85 | 94 | 100 |

As can be seen from Table 6, Samples No. 103 and 301 each meets the requirements regarding γh, γs and |IIEh|/|IIEs|. It was proved that coupler M-1 exhibited high chroma regarding red and blue, relative to coupler M-2, thereby providing a silver halide color reversal photographic material exhibiting superior color reproduction.

Example 4

Sample No. 401 was prepared similarly to Sample 103 in Example 1, except that yellow colloidal silver compound was used as a yellow filter, in place of DY-1, corresponding to formula (1) and compound DY-2, corresponding to formula (2), and the composition of the 11th layer was varied as described below.

| 11th Layer (Interlayer-5 Yellow Filter Layer) | |
|---|---|
| Yellow colloidal silver | 0.11 |
| AS-1 | 0.20 |
| High boiling solvent O-1 | 0.25 |
| DS-1 | 0.01 |
| Gelatin | 0.98 |

Further, Sample No. 402 was prepared to Sample No. 401, except that compound DM-1, corresponding to formula (3) used in the 6th layer was removed. In these samples, amounts of water-soluble dyes F-1, F-2 and F-3 were adjusted so that the speed of Sample No. 401 and 402 was equivalent to that of Sample 103.

Similarly to to Example 1, samples were evaluated with respect to γs, γh and |IIEh|/|IIEs|. Further, similarly to Example 3, samples were evaluated with respect to chroma of green. Results are shown in Table 7.

TABLE 7

| Sample No. | γh | γs | \|IIEh\|/\|IIEs\| | Green Chroma |
|---|---|---|---|---|
| 103 | 1.22 | 2.02 | 1.05 | 100 |
| 401 | 1.23 | 2.00 | 1.05 | 95 |
| 402 | 1.23 | 2.02 | 1.06 | 87 |

As can be seen from table 7, samples no. 103, 401 and 402 were silver halide color reversal photographic materials exhibiting close values with respect to the respective γs, γh and |IIEh|/|IIEs|, meeting the requirements of this invention. It was further noted that Samples no. 103 and 401, in which preferred dyes were used, exhibited high chroma of green, relative to Sample No. 402 not containing such a dye. It was noted that Sample No. 103, in which the specifically preferred dye was contained, exhibited the highest chroma of green.

What is claimed is:

1. A silver halide color reversal photographic material comprising on a support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler, wherein the photographic material has an ISO speed of 80 or more, and when exposed and processed in accordance with the following processing to obtain a characteristic curve based on status A density, the photographic material exhibits a gradation (γh) of at least 1.1 within the magenta dye density range of 0.3 to 1.0 on the characteristic curve and a gradation (γs) of at least 1.9 within the magenta dye density range of 1.0 to 2.5 on the characteristic curve and the photographic material meets the following requirement:

$$|IIEh|/|IIEs|>1.00$$

Processing:

| Step | Temperature | Time |
|---|---|---|
| First developing | 6 min. | 38° C. |
| Washing | 2 min. | 38° C. |
| Reversal | 2 min. | 38° C. |
| Color developing | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Drying | | |

wherein the following processing solutions are used:

| | |
|---|---|
| First Developing Solution | |
| Sodium tetrapolyphosphate | 2 g |
| Sodium sulfite | 20 g |
| Hydroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make 1000 ml (and pH of 9.60). | |
| Reversal Solution | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| Color Developing Solution | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |
| 2,2-Ethylendithioethanol | 1 g |
| Water to make 1000 ml (pH of 11.70) | |
| Conditioning solution | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| Bleaching Solution | |
| Sodium ethylenediaminetertaacetate (dihydrate) | 2 g |
| Ammonium ferric ethylenediaminetetraacetate (dihydrate) | 120 g |
| Potassium bromide | 100 g |
| Water to make 1000 ml (pH of 5.56) | |
| Fixing Solution | |
| Ammonium thiosulfate | 80 g |
| Sodium sulfite | 5 g |
| Sodium bisulfite | 5 g |
| Water to make 1000 ml (pH o 6.60) | |

and wherein IIEs and IIEh are interimage effect characteristic values at a density of 2.0 and 0.4 respectively, and are defined according to the following equations:

$$IIEs=IIEs(BG)+IIEs(BR)+IIEs(GB)+IIEs(GR)+IIEs(RB)+IIEs(RG) \quad (1)$$

$$IIEh=IIEh(BG)+IIEh(BR)+IIEh(GB)+IIEh(GR)+IIEh(RB)+IIEh(RG) \quad (2)$$

wherein when the photographic material is exposed to each of blue, green, red, yellow, magenta and cyan light for 1/100 sec. using a white light source of 5400 K and a blue gelatin filter, a green gelatin filter, a red gelatin filter, a yellow gelatin filter, a magenta gelatin filter, and a cyan gelatin filter and processed according to the foregoing processing to obtain characteristic curves based on status A density and to determine an exposure amount (Es) giving a density of 2.0 and an exposure amount (Eh) giving a density of 0.4 on the characteristic curves for each of the blue-sensitive layer, the green-sensitive layer and the red-sensitive layer, characteristic values of interimage effects at densities of 2.0 and 0.4, represented by IIEs(BG), IIEs(BR), IIEs(GB), IIEs(GR), IIEs(RB) and IIEs(RG); IIEh(BG), IIEh(BR), IIEh(GB), IIEh(GR), IIEh(RB) and IIEh(RG) are defined as follows;

$$IIEs(BG)=-\mathrm{Log}(Es(Y(G))-(-\mathrm{Log}(Es(B'(G))) \quad (3\text{-}1)$$

$$IIEh(BG)=-\mathrm{Log}(Eh(Y(G))-(-\mathrm{Log}(Eh(B'(G))) \quad (3\text{-}2)$$

$$IIEs(BR)=-\mathrm{Log}(Es(Y(R))-(-\mathrm{Log}(Es(B'(R))) \quad (4\text{-}1)$$

$$IIEh(BR)=-\mathrm{Log}(Eh(Y(R))-(-\mathrm{Log}(Eh(B'(R))) \quad (4\text{-}2)$$

$$IIEs(GB)=-\mathrm{Log}(Es(M(B))-(-\mathrm{Log}(Es(G'(B))) \quad (5\text{-}1)$$

$$IIEh(GB)=-\mathrm{Log}(Eh(M(B))-(-\mathrm{Log}(Eh(G'(B))) \quad (5\text{-}2)$$

$$IIEs(GR)=-\mathrm{Log}(Es(M(R))-(-\mathrm{Log}(Es(G'(R))) \quad (6\text{-}1)$$

$$IIEh(GR)=-\mathrm{Log}(Eh(M(R))-(-\mathrm{Log}(Eh(G'(R))) \quad (6\text{-}2)$$

$$IIEs(RB)=-\mathrm{Log}(Es(C(B))-(-\mathrm{Log}(Es(R'(B))) \quad (7\text{-}1)$$

$$IIEh(RB)=-\mathrm{Log}(Eh(C(B))-(-\mathrm{Log}(Eh(R'(B))) \quad (7\text{-}2)$$

$$IIEs(RG)=-\mathrm{Log}(Es(C(G))-(-\mathrm{Log}(Es(R'(G))) \quad (8\text{-}1)$$

$$IIEs(RG)=-\mathrm{Log}(Eh(C(G))-(-\mathrm{Log}(Eh(R'(G))) \quad (8\text{-}2)$$

wherein Es(Y(G)) and Eh(Y(G)) represent exposure amounts giving densities of 2.0 and 0.4 of the green-sensitive layer, respectively, when exposed through the yellow gelatin filter; Es(B'(G)) and Eh(B'(G)) represent exposure amounts giving densities of 2.0 and 0.4 of the green-sensitive layer, respectively, when exposed through the blue gelatin filter;

Es(Y(R)) and Eh(Y(R)) represent exposure amounts giving densities of 2.0 and 0.4 of the red-sensitive layer, respectively, when exposed through filter the yellow gelatin filter; Es(B'(R)) and Eh(B'(R)) represent exposure amounts giving densities of 2.0 and 0.4 of the red-sensitive layer, respectively, when exposed through the blue gelatin filter;

Es(M(B)) and Eh(M(B)) represent exposure amounts giving densities of 2.0 and 0.4 of the blue-sensitive layer, respectively, when exposed through the magenta gelatin filter; Es(G'(B)) and Eh(G'(B)) represent exposure amounts giving densities of 2.0 and 0.4 of the blue-sensitive layer, respectively, when exposed through the green gelatin filter;

Es(M(R)) and Eh(M(R)) represent exposure amounts giving densities of 2.0 and 0.4 of the red-sensitive layer, respectively, when exposed through the magenta gelatin filter; Es(G'(R)) and Eh(G'(R)) represent exposure amounts giving densities of 2.0 and 0.4 of the red-sensitive layer, respectively, when exposed through the green gelatin filter;

Es(C(B)) and Eh(C(B)) represent exposure amounts giving densities of 2.0 and 0.4 of the blue-sensitive layer, respectively, when exposed through the cyan gelatin filter; Es(R'(B)) and Eh(R'(B)) represent exposure amounts giving densities of 2.0 and 0.4 of the blue-sensitive layer, respectively, when exposed through the red gelatin filter;

Es(C(G)) and Eh(C(G)) represent exposure amounts giving densities of 2.0 and 0.4 of the green-sensitive layer, respectively, when exposed through the cyan gelatin filter; Es(R'(G)) and Eh(R'(G)) represent exposure amounts giving densities of 2.0 and 0.4 of the green-sensitive layer, respectively, when exposed through the red gelatin filter.

2. The color reversal photographic material of claim 1, wherein the gradation (γh) is 1.1 to 1.3 and the gradation (s) being 1.95 to 2.2.

3. The color reversal photographic material of claim 1, wherein the photographic material meets the following requirement:

$$|IIEh/IIEs|>1.15.$$

4. The color reversal photographic material of claim 1, wherein at least one color-sensitive layer of said blue-sensitive, green-sensitive, and red-sensitive silver halide emulsion layers comprises plural color-sensitive sublayers having the same color-sensitivity, differing in speed and containing silver halide grains and a dye forming coupler, and at least 30% of a total projected area of silver halide grains contained in the lowest speed sublayer of the plural color-sensitive sublayers is accounted for by silver halide grains having a proportion of a (100) face per grain of not less than 70%.

5. The color reversal photographic material of claim 4, wherein said lowest-speed sublayer contains at least 15 mg/Ag·mol of a compound represented by the following formula (R-1):

formula (R-1)

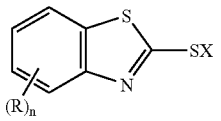

wherein X is a hydrogen atom or an alkali metal; R is a hydrogen atom, a halogen atom or an alkyl group having 1 to 5 carbon atoms; and n is an integer of 1 to 4.

6. The color reversal photographic material of claim 4, wherein said one color-sensitive layer is the green-sensitive silver halide emulsion layer, which comprises plural green-sensitive sublayers differing in speed and containing silver halide grains and a magenta dye forming coupler, and at least 30% of a total projected area of silver halide grains contained in the lowest speed sublayer of the plural green-sensitive sublayers is accounted for by silver halide grains having a proportion of a (100) face per grain of not less than 70%.

7. The color reversal photographic material of claim 1, wherein said magenta coupler is represented by the following formula (M-1) or (M-1'):

formula (M-1)

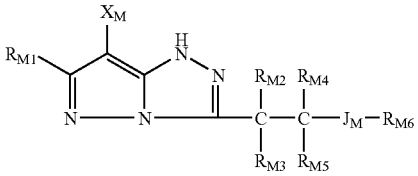

formula (M-1')

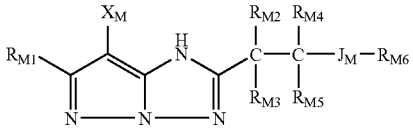

wherein $R_{M1}$ represents a hydrogen atom or a substituent; $R_{M2}$ and $R_{M3}$ each represents an alkyl group; $R_{M4}$ and $R_{M5}$ each represents a hydrogen atom or an alkyl group; $J_M$ represents —O—C(═O)—, —$NR_{M7}$CO— or —$NR_{M7}SO_2$—, in which $R_{M7}$ represents a hydrogen atom or an alkyl group; $R_{M6}$ represents an alkyl group, an aryl group, an alkoxy group, an aryloxy group, an alkylamino group or an arylamino group; $X_M$ represents a hydrogen atom, a halogen atom or a group capable of being released upon reaction with an oxidation product of a color developing agent.

8. The color reversal photographic material of claim 1, wherein at least one color-sensitive layer of said blue-sensitive, green-sensitive, and red-sensitive silver halide emulsion layers comprises plural color-sensitive sublayers having the same color-sensitivity, differing in speed and containing silver halide grains and a dye forming coupler, and at least 50% of a total projected area of silver halide grains contained in the highest speed sublayer of the plural color-sensitive sublayers is accounted for by tabular silver halide grains having an aspect ratio of 5 or more, an average iodide content of host grains of not more than 4 mol %, at least 10 dislocation lines in the fringe portions of the grains and a coefficient of variation of circular equivalent grain diameter of not more than 25%.

9. The color reversal photographic material of claim 8, wherein said one color-sensitive layer is the green-sensitive silver halide emulsion layer, which comprises plural green-sensitive sublayers differing in speed and containing silver halide grains and a magenta dye forming coupler, and at least 50% of a total projected area of silver halide grains contained in the highest speed sublayer of the plural green-sensitive sublayers is accounted for by tabular silver halide grains having an aspect ratio of 5 or more, an average iodide content of host grains of not more than 4 mol %, at least 10 dislocation lines in the fringe portions of the grains and a coefficient of variation of circular equivalent grain diameter of not more than 25%.

10. The color reversal photographic material of claim 1, wherein the photographic material contains a compound represented by the following formula (1), (2) or (3):

formula (1)

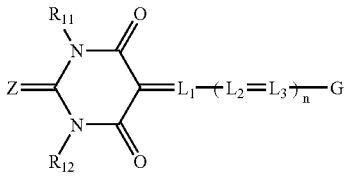

wherein Z is an oxygen atom or sulfur atom; $L_1$, $L_2$ and $L_3$ are each a methine group; n is 0, 1 or 2; G is an aromatic hydrocarbon group or a heterocyclic group; $R_{11}$ and $R_{12}$ are each a hydrogen atom or a substituent, provided that at least one of $R_{11}$ and $R_{12}$ is -$A_1$-COOH, in which $A_1$ is a bivalent aliphatic group;

formula (2)

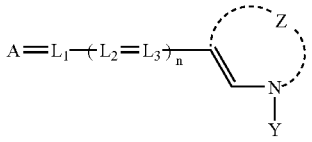

wherein A is an acidic nuclear; $L_1$, $L_2$ and $L_3$ are each a methine group; n is 0, 1 or 2; Z is an atomic group necessary to form a nitrogen containing aromatic heterocycle; Y is —$C(R_1)(R_2)(R_3)$ or a heterocyclic group, in which $R_1$ and $R_2$ is a hydrogen atom or an alkyl group, provided that $R_1$ and $R_2$ may combine with each other to form a ring, and $R_3$ is a hydrogen atom or an electron-withdrawing group having a Hammett $\sigma_p$ value of 0.3 or more, provided that all of $R_1$, $R_2$ and $R_3$ are not hydrogen atoms at the same time and the aromatic heterocycle contains a carboxy or alkylsufoneamido group;

formula (3)

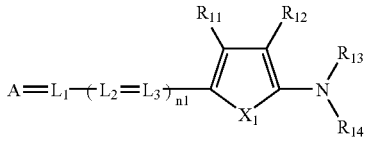

wherein A is an acidic nuclear; $L_1$, $L_2$ and $L_3$, are each a methine group; n is 0, 1 or 2; $X_1$ is an oxygen atom, sulfur atom or selemium atom; $R_{11}$ and $R_{12}$ are each a hydrogen atom or an alkyl group, provided that $R_{11}$ and $R_{12}$ may combine with each other to form a ring; $R_{13}$ and $R_{14}$ are each an alkyl group.

* * * * *